US008353435B2

(12) United States Patent
Gross et al.

(10) Patent No.: US 8,353,435 B2
(45) Date of Patent: Jan. 15, 2013

(54) MULTISTAGE SOLENOID FASTENING TOOL WITH DECREASED ENERGY CONSUMPTION AND INCREASED DRIVING FORCE

(75) Inventors: Paul G. Gross, White Marsh, MD (US); Robert Alan Usselman, Forest Hill, MD (US); Andrew E. Seman, Jr., Pylesville, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 13/554,223

(22) Filed: Jul. 20, 2012

(65) Prior Publication Data

US 2012/0286017 A1 Nov. 15, 2012

Related U.S. Application Data

(60) Division of application No. 12/536,787, filed on Aug. 6, 2009, now Pat. No. 8,225,978, which is a continuation-in-part of application No. 12/402,974, filed on Mar. 12, 2009, now Pat. No. 7,665,540, which is a division of application No. 11/670,088, filed on Feb. 1, 2007, now Pat. No. 7,537,145.

(60) Provisional application No. 61/087,547, filed on Aug. 8, 2008.

(51) Int. Cl.
*B25C 1/06* (2006.01)

(52) U.S. Cl. ..... 227/131; 227/134

(58) Field of Classification Search ..... 227/2, 120, 227/129, 131, 134
See application file for complete search history.

(56) References Cited

U.S. PATENT DOCUMENTS 2,861,778 A * 11/1958 Spurlin ..... 173/117
2,923,937 A 2/1960 Laucher
3,193,167 A 7/1965 Newton
3,552,627 A 1/1971 Moreno
3,589,587 A 6/1971 Manganaro
(Continued)

FOREIGN PATENT DOCUMENTS

DE 4300871 7/1994
(Continued)

OTHER PUBLICATIONS

Parts Reference Guide (SCN40R), Senco Products, Inc., Cincinnati, OH 45244 (5 pages).

(Continued)

*Primary Examiner* — Paul R Durand
(74) *Attorney, Agent, or Firm* — Harness, Dickey & Pierce, P.L.C.

(57) ABSTRACT

A fastening device that drives one or more fasteners into a workpiece generally includes a tool housing and a multistage solenoid contained in the tool housing. The multistage solenoid includes an armature member that travels through at least a first stage, a second stage, and a sense coil disposed therebetween. A driver blade assembly includes a blade member connected to the armature member. The driver blade assembly is operable between an extended condition and a retracted condition. A control module determines a position of the armature member relative to at least one of the first stage and the second stage based on a signal from the sense coil. The control module adjusts a force imparted on the armature by at least one of the first stage, the second stage, and a combination thereof based on the signal from the sense coil.

10 Claims, 19 Drawing Sheets

U.S. PATENT DOCUMENTS

| | | | | |
|---|---|---|---|---|
| 3,636,707 | A | | 1/1972 | Saari et al. |
| 3,672,029 | A | | 6/1972 | Butriss |
| 3,786,286 | A | | 1/1974 | Palsson et al. |
| 3,803,840 | A | | 4/1974 | Toczycki |
| 3,820,705 | A | | 6/1974 | Beals |
| 3,857,081 | A | | 12/1974 | Gebelein, Jr. |
| 4,005,812 | A | | 2/1977 | Doyle et al. |
| 4,015,671 | A | * | 4/1977 | Borisov et al. ..... 173/117 |
| 4,053,094 | A | | 10/1977 | Males |
| 4,149,297 | A | | 4/1979 | Monacelli |
| 4,163,310 | A | | 8/1979 | Sigmund |
| 4,163,311 | A | | 8/1979 | Sigmund |
| 4,183,453 | A | | 1/1980 | Barrett et al. |
| 4,230,249 | A | | 10/1980 | Nasiatka et al. |
| 4,270,687 | A | | 6/1981 | Maurer |
| 4,293,088 | A | | 10/1981 | Barrett et al. |
| 4,298,072 | A | | 11/1981 | Baker et al. |
| 4,313,552 | A | | 2/1982 | Maurer |
| 4,319,705 | A | | 3/1982 | Geist et al. |
| 4,375,867 | A | | 3/1983 | Novak et al. |
| 4,442,965 | A | | 4/1984 | Leistner |
| 4,524,897 | A | | 6/1985 | Bachmann |
| 4,549,681 | A | | 10/1985 | Yamamoto et al. |
| 4,553,074 | A | | 11/1985 | Jacquemet |
| 4,556,803 | A | | 12/1985 | Weigert |
| 4,573,621 | A | | 3/1986 | Merkator et al. |
| 4,597,517 | A | | 7/1986 | Wagdy |
| 4,821,614 | A | | 4/1989 | Fleet et al. |
| 4,863,089 | A | | 9/1989 | McCardle et al. |
| 4,872,381 | A | | 10/1989 | Stroms |
| 4,942,996 | A | | 7/1990 | Wolfberg et al. |
| 5,257,014 | A | | 10/1993 | Zimmermann |
| 5,634,582 | A | | 6/1997 | Morrison, Jr. et al. |
| 5,760,552 | A | * | 6/1998 | Chen et al. ..... 318/122 |
| 6,431,430 | B1 | | 8/2002 | Jalbert et al. |
| 6,499,642 | B1 | | 12/2002 | Amada |
| 6,598,777 | B2 | | 7/2003 | Osuga et al. |
| 6,796,477 | B2 | * | 9/2004 | Chen ..... 227/2 |
| 6,854,530 | B1 | * | 2/2005 | Yiu ..... 173/1 |
| 7,099,136 | B2 | | 8/2006 | Seale et al. |
| 2002/0117531 | A1 | | 8/2002 | Schell et al. |
| 2005/0045352 | A1 | * | 3/2005 | Yiu ..... 173/1 |
| 2007/0246015 | A1 | | 10/2007 | Moreno et al. |
| 2008/0185418 | A1 | | 8/2008 | Gross et al. |
| 2008/0251559 | A1 | | 10/2008 | Uejima et al. |

FOREIGN PATENT DOCUMENTS

| | | |
|---|---|---|
| EP | 0226027 | 6/1987 |
| KR | 20-1984-0001187 | 7/1984 |
| KR | 20-1989-0006131 | 9/1989 |
| KR | 10-1999-0022357 | 3/1999 |
| KR | 10-2007-0007328 | 1/2007 |
| WO | WO 0214026 | 2/2002 |

OTHER PUBLICATIONS

Parts List for D51431 Type 1, www.dewaltservicenet.com; Copyright 2005; pp. 1-5.

International Search Report dated Mar. 3, 2010 for PCT Int'l Appln. No. PCT/US2009/053141, 3 pages.

Written Opinion of the International Searching Authority dated Mar. 3, 2010 for PCT Int'l. Appln. No. PCT/US2009/053141, 4 pages.

* cited by examiner

Magnetizing Condition

Demagnetizing Condition

MULTISTAGE SOLENOID FASTENING TOOL WITH DECREASED ENERGY CONSUMPTION AND INCREASED DRIVING FORCE

CROSS-REFERENCE TO RELATED APPLICATIONS

This application is a divisional of U.S. application Ser. No. 12/536,787, filed Aug. 6, 2009, which claims the benefit of U.S. Provisional Application No. 61/087,547, filed on Aug. 8, 2008. The above disclosures are hereby incorporated by reference. The above-noted parent application claims the benefit and is a continuation-in-part of U.S. patent application Ser. No. 12/402,974, filed Mar. 12, 2009 (now U.S. Pat. No. 7,665,540), which is a divisional of U.S. patent application Ser. No. 11/670,088, filed Feb. 1, 2007 (now U.S. Pat. No. 7,537,145).

FIELD OF THE INVENTION

The present teachings relate to a cordless fastening tool and more specifically relate to a multistage solenoid that can extend and retract a driver blade of the cordless fastening tool and adjust the magnetic fields of each of the stages of the multistage solenoid based on a position of the armature within the multistage solenoid. The present teachings further relate to an internal elastic member and an external coil member that are used to retract the driver blade without the need to energize the multistage solenoid. The present teachings additionally relate to methods of transient voltage boosting when energizing the individual stages of the multistage solenoid to increase the force imparted to the driver blade and/or decrease the relative size of the multistage solenoid in the cordless fastening tool.

BACKGROUND OF THE INVENTION

Traditional fastening tools can employ pneumatic actuation to drive a fastener into a workpiece. In these tools, air pressure from a pneumatic system can be utilized to both drive the fastener into the workpiece and to reset the tool after driving the fastener. It will be appreciated that in the pneumatic system, a hose and a compressor are required to accompany the tool. A combination of the hose, the tool and the compressor can provide for a large, heavy and bulky package that can be relatively inconvenient and cumbersome to transport. Other traditional fastening tools can be battery powered and can engage a transmission with an electric motor to drive a fastener. The energy consumption of the electric motor as it drives the transmission however, can limit battery life.

A solenoid has been used in fastening tools to drive small fasteners. Typically, the solenoid executes multiple impacts on the fastener to generate the force needed to drive the fastener into the workpiece. In other instances, corded fastening tools, i.e., connected to wall voltage, can use the solenoid to drive the fastener in a single stroke.

SUMMARY OF THE INVENTION

The present teachings generally include a fastening device that drives one or more fasteners into a workpiece. The fastening device generally includes a tool housing and a multistage solenoid contained in the tool housing. The multistage solenoid includes an armature member that travels through at least a first stage, a second stage, and a sense coil disposed therebetween. A driver blade assembly includes a blade member connected to the armature member. The driver blade assembly is operable between an extended condition and a retracted condition. A control module determines a position of the armature member relative to at least one of the first stage and the second stage based on a signal from the sense coil. The trigger assembly is connected to the control module and partially contained within the housing. The trigger assembly is operable to activate a driver sequence that moves the driver blade between the retracted condition and the extended condition. The control module adjusts a force imparted on the armature by at least one of the first stage, the second stage, and a combination thereof based on the signal from the sense coil.

Further areas of applicability will become apparent from the description provided herein. It should be understood that the description and specific examples are intended for purposes of illustration only and are not intended to limit the scope of the present teachings.

BRIEF DESCRIPTION OF THE DRAWINGS

The drawings described herein are for illustration purposes only and are not intended to limit the scope of the present teachings in any way.

DETAILED DESCRIPTION OF PREFERRED EMBODIMENTS

The following description of the various aspects of the present teachings is merely exemplary in nature and is in no way intended to limit the teachings, their application or uses. As used herein, the term module and/or control module can refer to an application specific integrated circuit (ASIC), an electronic circuit, a processor (shared, dedicated or group) and memory that executes one or more software or firmware programs, a combinational logic circuit, other suitable components and/or one or more suitable combinations thereof that provide the described functionality.

Figure 1:
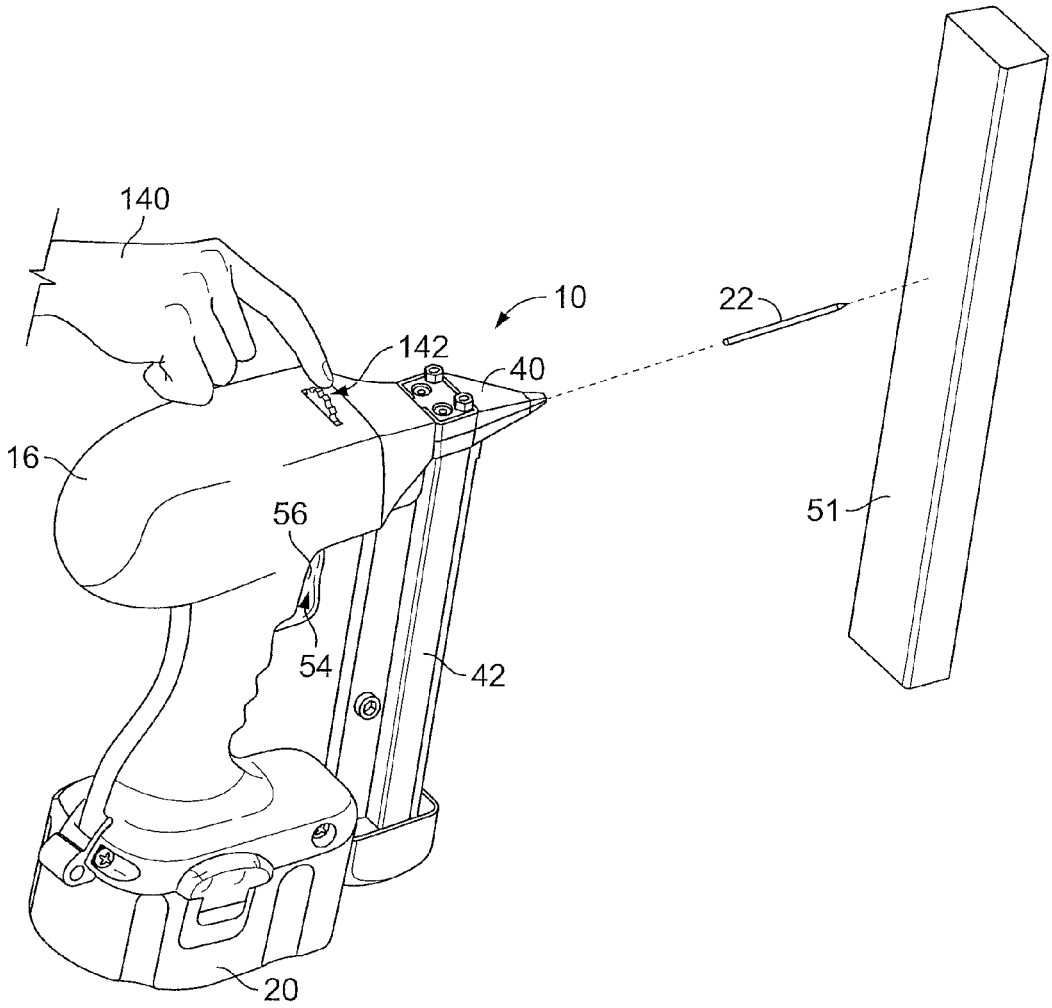
FIG. 1 is a perspective view of an exemplary cordless fastening tool having a multistage solenoid capable of inserting a fastener into a workpiece in accordance with the present teachings.
Figure 2:
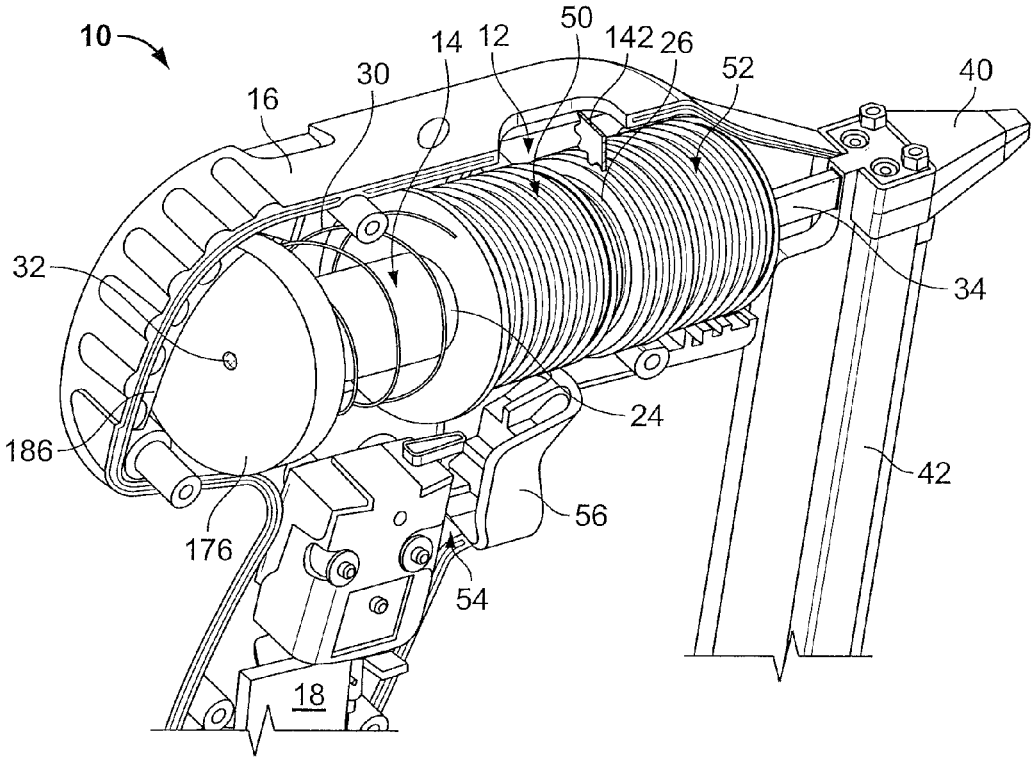
FIG. 2 is a partial perspective and cross-sectional view of the cordless fastening tool of FIG. 1 and shows the multistage solenoid in a tool housing above a fastener magazine in accordance with the present teachings.

With reference to FIGS. 1 and 2, an exemplary fastening tool 10 can include a multistage solenoid 12 that can drive a driver blade assembly 14 between a retracted condition (see, e.g., FIG. 3) and an extended condition (see, e.g., FIG. 5) in accordance with the present teachings. The fastening tool 10 can include an exterior clam shell exterior tool housing 16 that can contain a control module 18. The control module 18 can control (e.g., energize and de-energize) the multistage solenoid 12 to move the driver blade assembly 14. Each time the driver blade assembly 14 is moved by the multistage solenoid 12, the remaining useful charge of a battery 20 can be consumed. In the various examples, the battery 20 can be configured with a suitable nominal voltage such as 7.2, 12, 36 volts, etc. using a suitable battery chemistry such as nickel cadmium, lithium ion, etc. The fastening tool 10 can also be configured to be hybrid between being powered by an alternating current (AC) power source (e.g., wall voltage) and a direct current (DC) power source (e.g., the battery 20).

It will be appreciated in light of the present disclosure that the less power used by the multistage solenoid 12 to drive a fastener 22, the longer the battery 20 can maintain the nominal voltage (i.e., the useful charge) to operate the fastening tool 10. In one example, by determining a position of an armature 24 with a sense coil 26 between the stages of the multistage solenoid 12, the energy consumed by the multistage solenoid 12 can be conserved. The conservation of energy can be accomplished by, for example, reducing the amount of energy needed to impart a certain amount of force on the driver blade assembly 14, as discussed herein.

Figure 8:
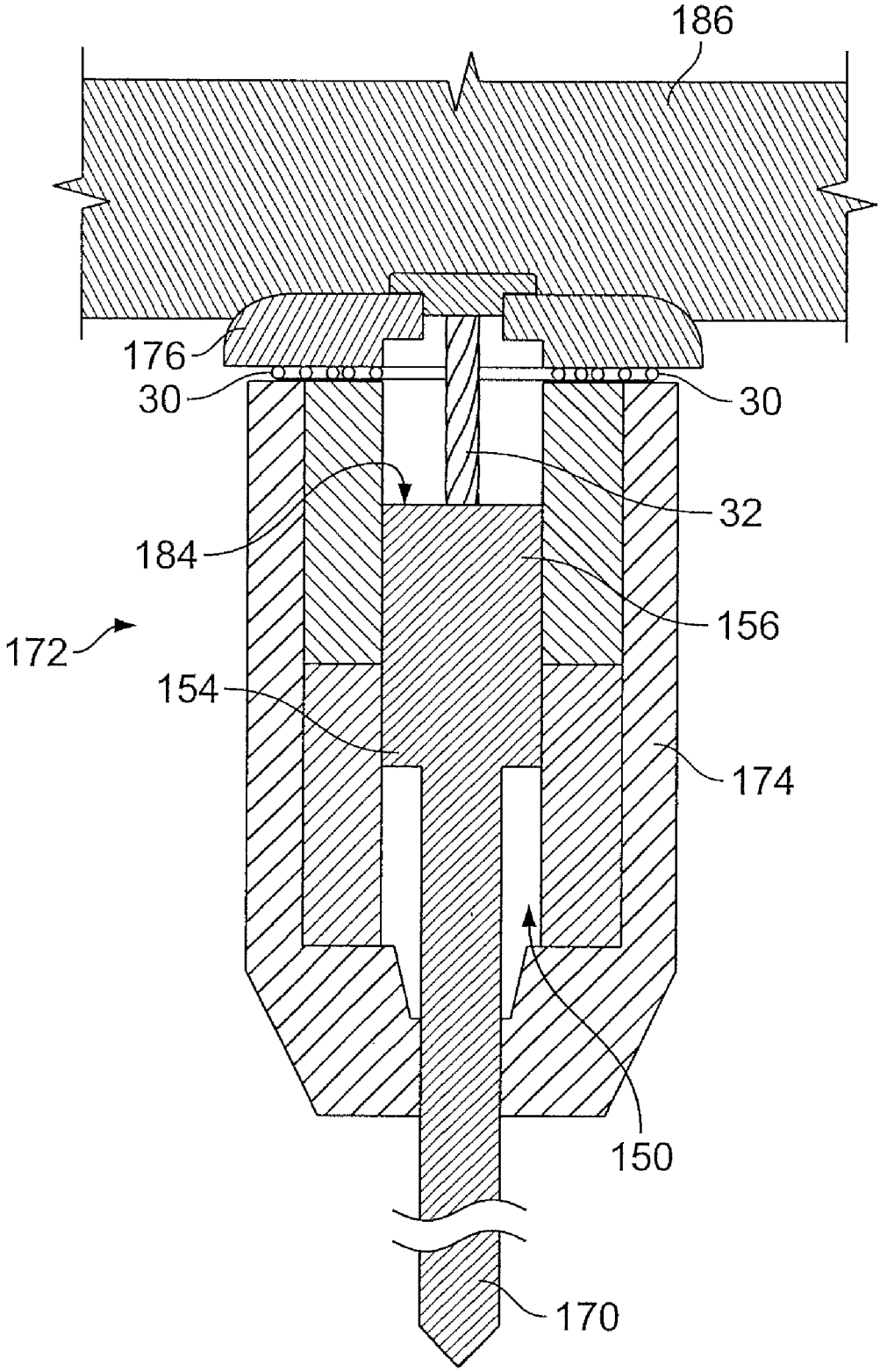
FIG. 8 is similar to FIG. 7 and shows the driver blade assembly progressing from the retracted condition to the extended condition in accordance with the present teachings.
Figure 9:
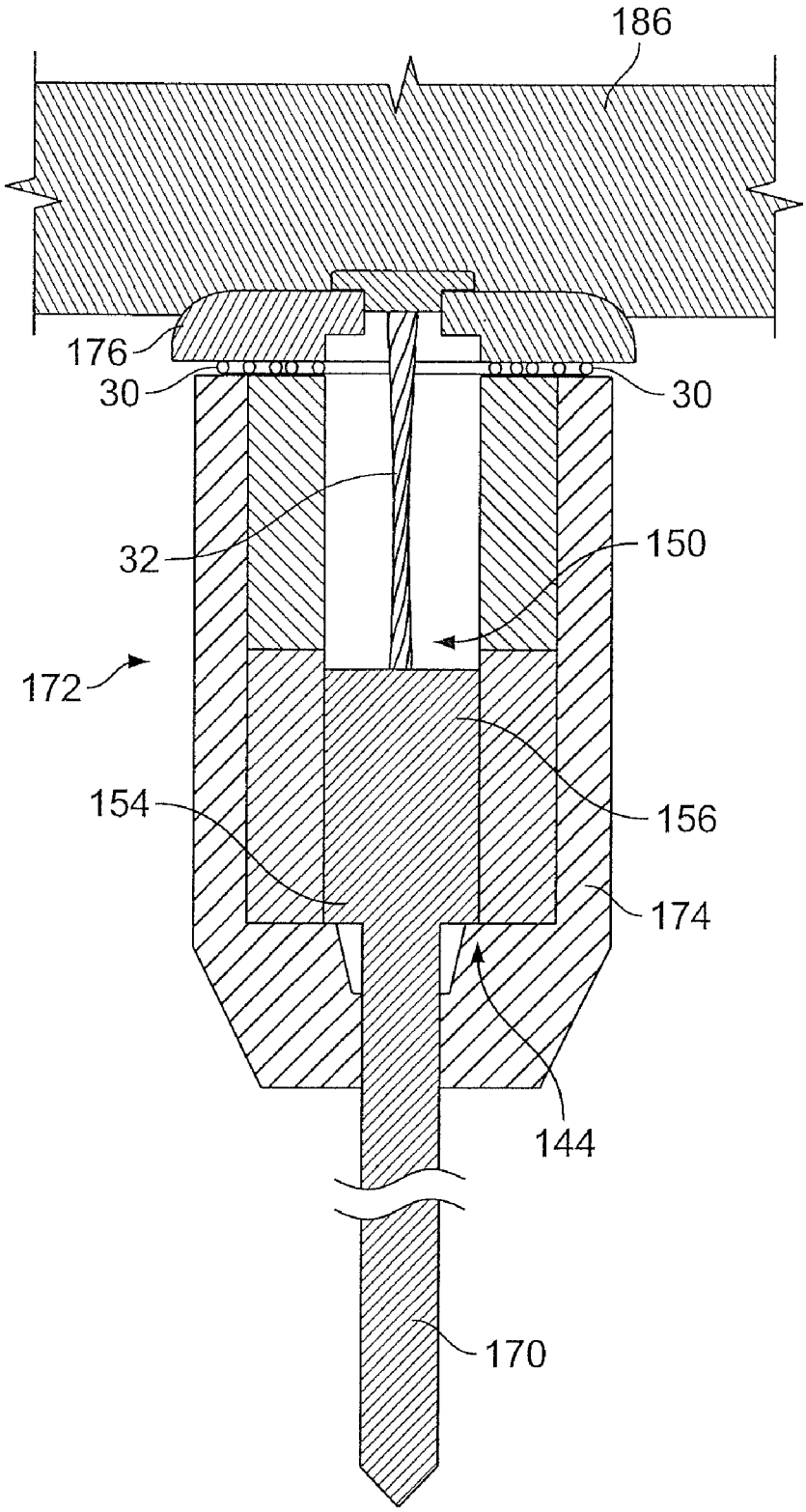
FIG. 9 is similar to FIG. 7 and shows the driver blade assembly in the extended condition in accordance with the present teachings.
Figure 10:
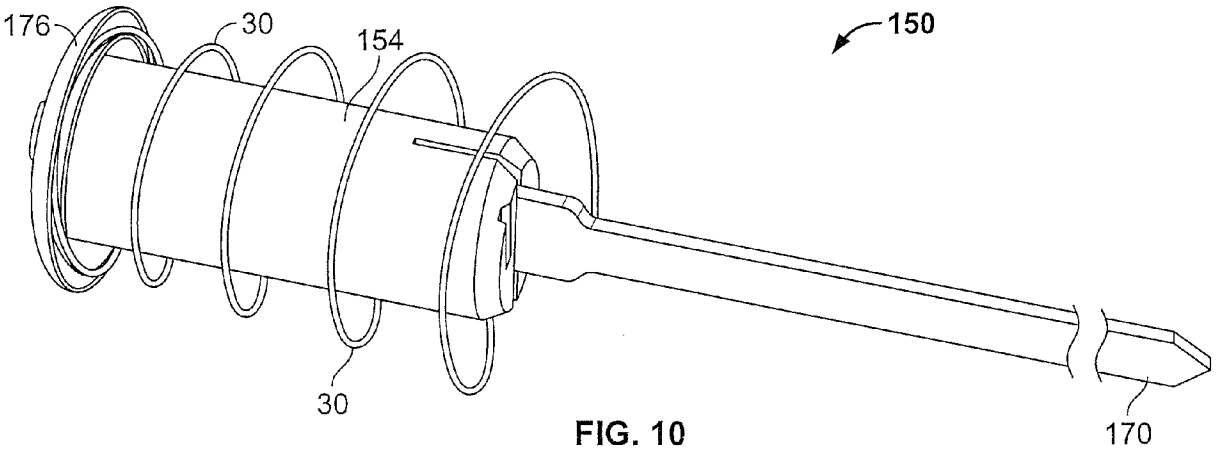
FIG. 10 is a perspective view of the driver blade assembly as illustrated in the diagram of FIG. 7 having the internal elastic member contained within a cylindrical member of the armature and the external coil member connected to a cap member in accordance with the present teachings.

In a further example, an external coil member 30 and an internal elastic member 32 (FIGS. 7, 8 and 9) can move the driver blade assembly 14 from the extended condition to the retracted condition and, therefore, can avoid the need to consume energy with the multistage solenoid 12 to return the driver blade assembly 14 to the retracted condition. In yet another example, the fastening tool 10 can use a method of transient voltage boosting to energize the multistage solenoid 12 at a higher but transient voltage. When the multistage solenoid 12 is not being boosted to a boost voltage, the control module 18 can operate the multistage solenoid 12 at the nominal voltage of the battery 20. While the multistage solenoid 12 in the various aspects of the present teachings is illustrated with a first stage and a second stage, the multistage solenoid 12 can include one or more additional stages in suitable implementations, as discussed herein.

The multistage solenoid 12 can move the driver blade assembly 14 to the extended condition so that a portion of a driver blade 34 can move into a nosepiece 40. In doing so, the driver blade 34 can drive the fastener 22 from a fastener magazine 42 into a workpiece 51. In this regard, the fastener magazine 42 can sequentially feed one or more of the fasteners 22 into the nosepiece 40.

The battery 20 can be mechanically coupled to the exterior housing 16 and electrically coupled to the multistage solenoid 12 via the control module 18. As such, the control module 18 can control a first stage 50 and a second stage 52 of the multistage solenoid 12 to magnetically move the driver blade assembly 14 so that the driver blade 34 can drive the fastener 22 into the workpiece 51 when a trigger assembly 54 is retracted. In doing so, the trigger assembly 54, by way of retracting a trigger 56, can control the execution of a driver sequence. The driver sequence can include moving the driver blade assembly 14 from the retracted condition (FIG. 3) to the extended condition (FIG. 5) and back to the retracted condition.

It will be appreciated in light of the disclosure that the movement of the driver blade assembly during the driver sequence can be completed solely with the energizing (and de-energizing) of the stages 50, 52 of the multistage solenoid 12. In one example, the polarity of the current through the multistage solenoid 12 can be reversed to change the direction of the force imparted on the driver blade assembly 14. In an attempt to, among other things, conserve electrical power and reduce the size and weight of the fastening tool 10, the exterior coil member 30 and the internal elastic member 32 can move the driver blade assembly 14 from the extended condition to the retracted condition without the need to energize the multistage solenoid 12. It will also be appreciated in light of the disclosure that the fastener 22 can be one or more nails, staples, brads, clips, or any such suitable fasteners that can be driven into the workpiece 51.

Figure 3:
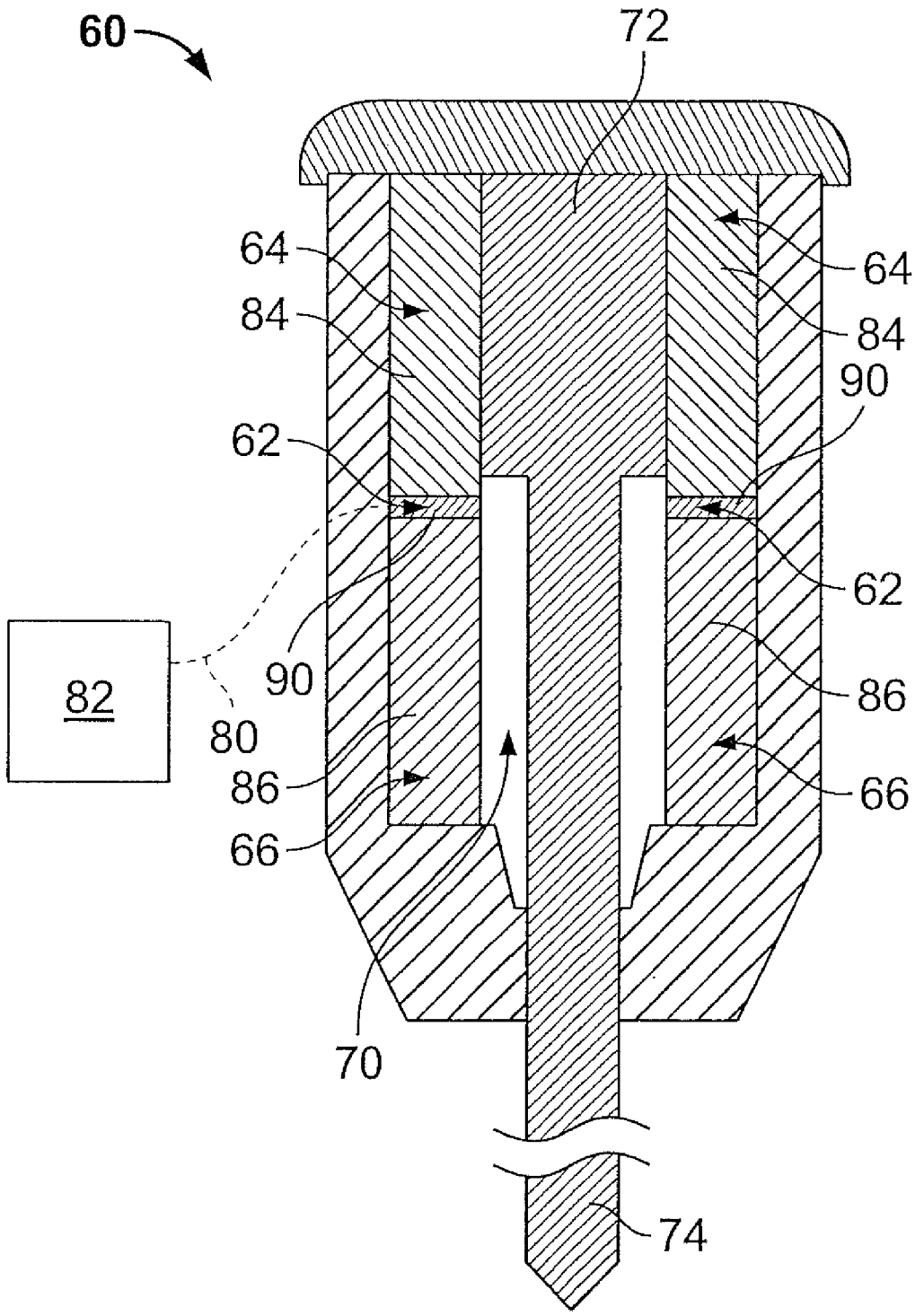
FIG. 3 is a diagram of a multistage solenoid having a sense coil between a first stage and a second stage that senses the position of an armature of the multistage solenoid in accordance with the present teachings.
Figure 4:
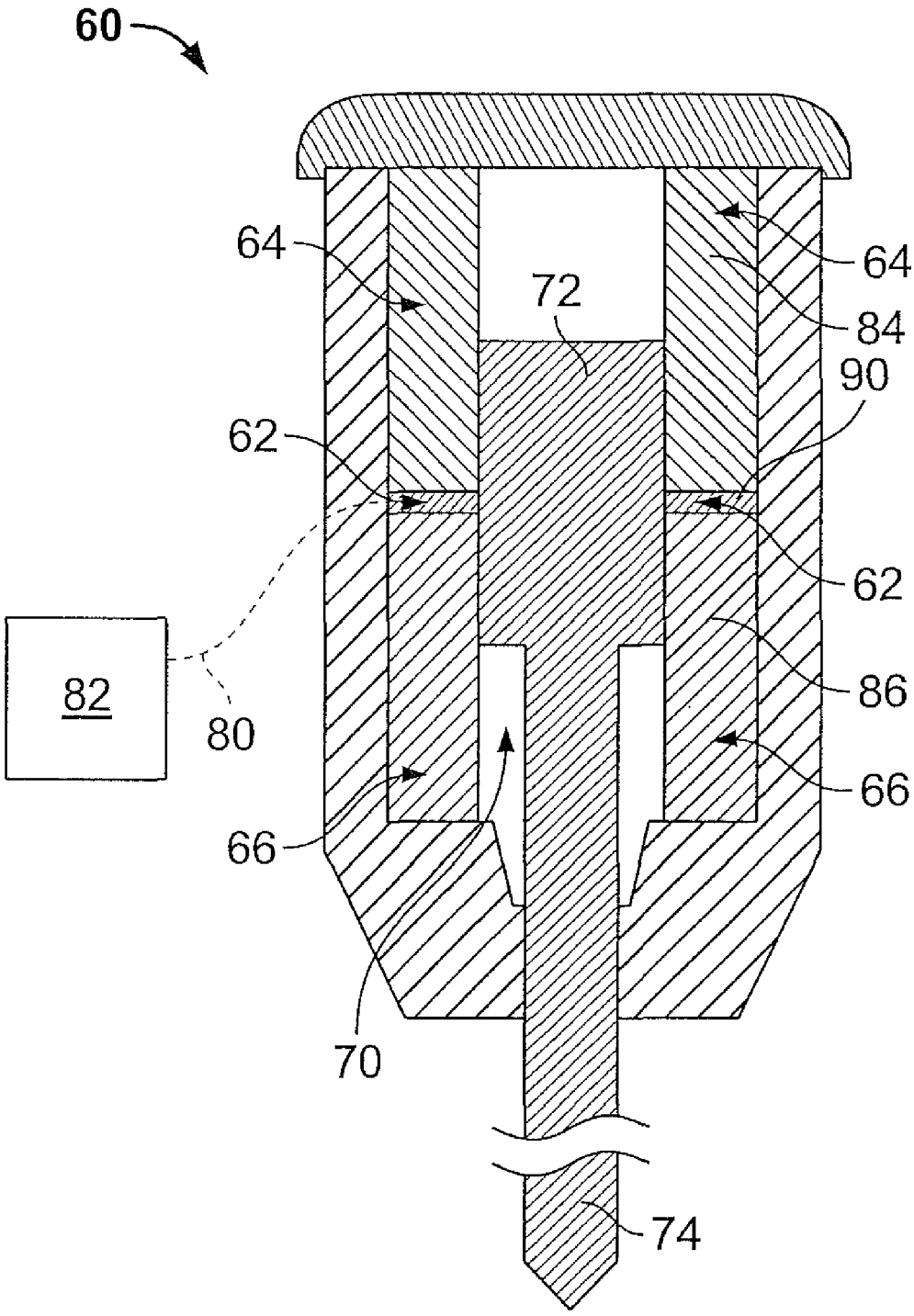
FIG. 4 is similar to FIG. 3 and shows the armature and a driver blade of a driver blade assembly progressing from a retracted condition to an extended condition in accordance with the present teachings.
Figure 5:
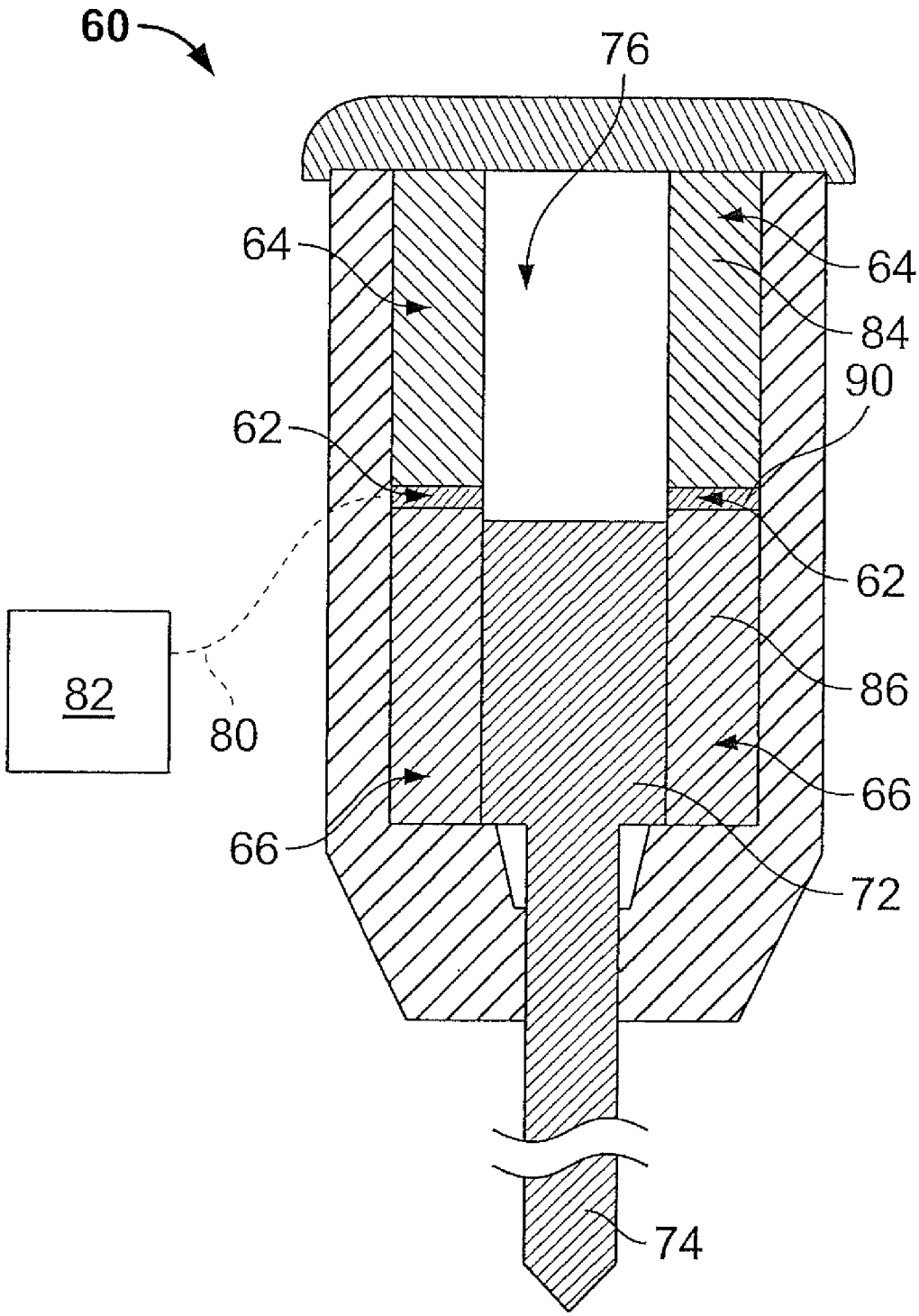
FIG. 5 is also similar to FIG. 3 and shows the armature and the driver blade in the extended condition in accordance with the present teachings.

With reference to FIGS. 3, 4 and 5, the fastening tool 10 can be configured with a multistage solenoid 60 that can include a sense coil 62 disposed between a first stage 64 and a second stage 66 of the multistage solenoid 60, which can be similar to the sense coil 26 disposed between the stages 50, 52 (FIG. 2). The sense coil 62 can sense the position of a driver blade assembly 70 that includes an armature 72 of the multistage solenoid 60 and a driver blade 74 connected thereto. More specifically, the sense coil 62 can generate a signal 80 that can be indicative of the position of the armature 72. The signal 80 can be received by the control module 82.

The signal 80 from the sense coil 62 can, for example, indicate changes in current through the sense coil 62. Changes in current can be due to movement of the armature 72. In this regard, the armature 72 can move relative to the magnetic fields generated by windings 84 of the first stage 64 and windings 86 of the second stage 66, when one or more of the stages 64, 66 are energized. The signal 80 can therefore be indicative of the position of the armature 72 and when the position of the armature 72 is known, the position of the driver blade 74 is known as well. It will be appreciated in light of the disclosure that there are additional ways to detect the position of the armature 72 relative to the first stage 64 and/or the second stage 66 of the multistage solenoid 60, but the sense coil 62 can provide the signal 80 (in addition to or in lieu of) other methods and/or systems that can be used to detect the position of the armature 72 in the multistage solenoid 60.

In one example, the sense coil 62 can be one or more copper windings 90 disposed between the windings 84 of the first stage 64 and the windings 86 of the second stage 66. In further examples, multiple sense coils can be disposed between multiple stages of a multistage solenoid 100. In one example, the multistage solenoid 100 can include a sense coil 102 that can be disposed between a first stage 104 and a second stage 106. A sense coil 108 can be disposed between the second stage 106 and a third stage 110 of the multistage solenoid 100. A sense coil 112 can be disposed between the third stage 110 and a fourth stage 114 of the multistage solenoid 100. The sense coils 102, 108, and 112 can each provide a signal 120, 122, and 124, respectively, indicative of the position of an armature 130 relative to each of the stages 104, 106, 110, 114 of the multistage solenoid 100. As the armature 130 travels through the multistage solenoid 100, each of the sense coils 102, 108, 112 can detect the position of the armature 130, when a driver blade assembly 132 (that includes the armature 130) travels between the stages 104, 106, 110, 114 of the multistage solenoid 100.

It will be appreciated in light of the disclosure that as the number of stages increases in the multistage solenoid 12, 60, 100 that the resolution of the signal 80, 120, 122, 124 produced by the sense coil 62, 102, 108, 112 can be more relatively useful than other methods and/or systems of detecting positions of the armature 72, 130. More specifically, a signal to noise ratio of the one or more signals 80, 120, 122, 124 from the sense coils 62, 102, 108, 112 can be greater than that from a method and/or system used to detect, for example, a current inflection point associated with the multistage solenoid 12, 60, 100 that otherwise does not require a sense coil. The relative increase of the signal to noise ratio of the signal 80, 120, 122, 124 from the sense coil 62, 102, 108, 112 can be shown to justify an additional component (i.e., the one or more sense coils) between each of the stages 50, 52, 64, 66, 104, 106, 110, 114 of the respective multistage solenoid 12, 60, 100.

Returning to FIGS. 1-5, by knowing the position of the armature 24, 72 relative to the sense coil 26, 62, a value of a velocity of the driver blade 34, 74 can be determined as the driver blade 34, 74 travels through the multistage solenoid 12, 60. As shown in FIG. 1, a user 140 of the fastening tool 10 can adjust a depth setting control 142 to set a depth at which the driver blade 34, 74 can drive the fastener 22 into the workpiece 51. In this regard, the control module 18, 82 can determine the proper acceleration or deceleration needed to maintain a desired velocity of the driver blade 34, 74 to obtain the desired depth of the fastener 22 as set on the depth setting control 142.

Figure 6:
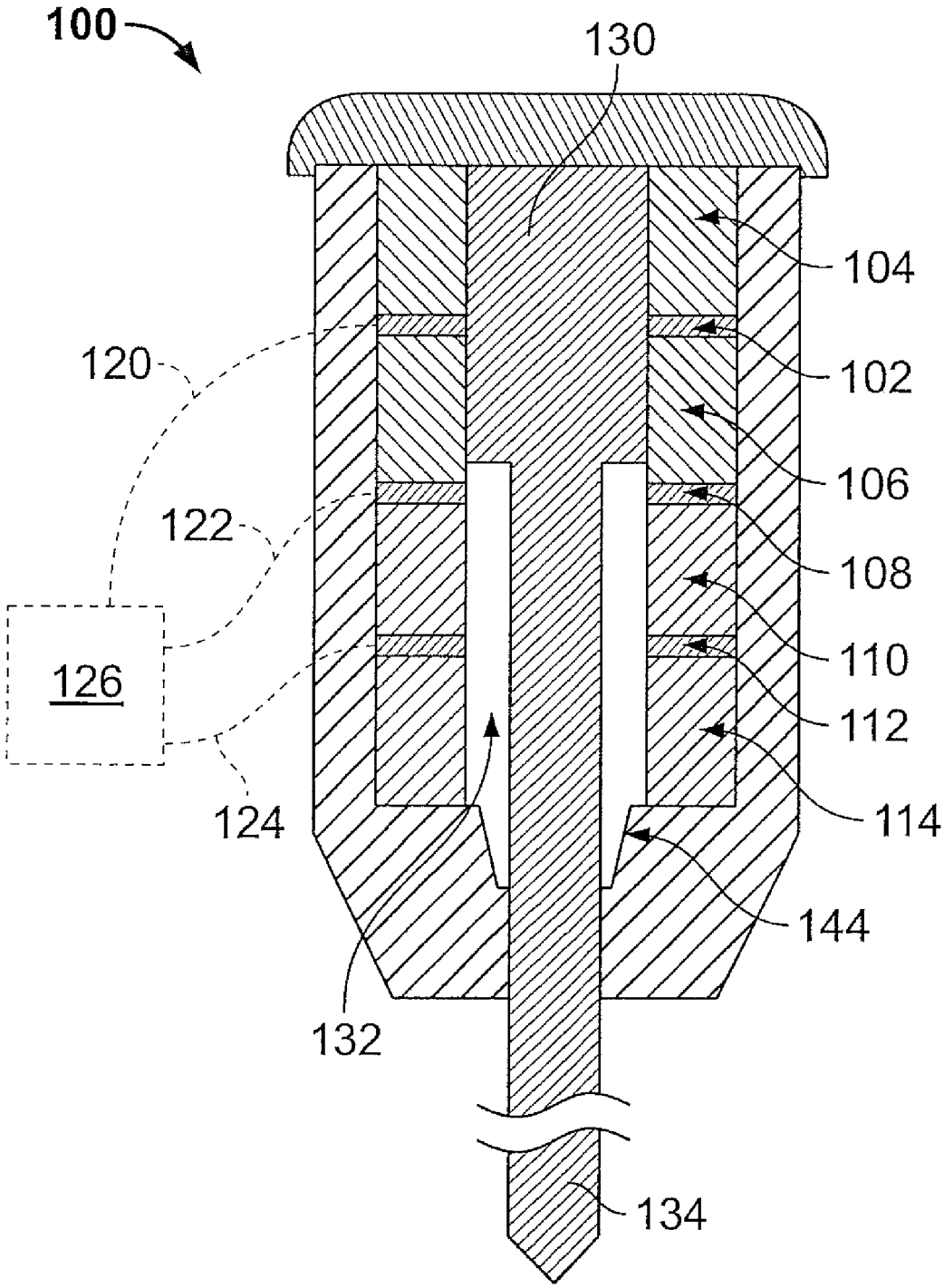
FIG. 6 is a diagram of another example of a multistage solenoid having a sense coil between a first stage and a second stage, a sense coil between the second stage and a third stage and a sense coil between the third stage and a fourth stage that each sense the position of an armature of the multistage solenoid in accordance with the present teachings.

As the driver blade 34, 74 travels through the multistage solenoid 12, 60, the signal 80 detected with the sense coil 26, 62 can be used to determine whether the velocity is sufficient (too high or too low) to deliver the desired depth setting. As such, in situ changes to the velocity of the driver blade 34, 74 can be made by adjusting the energy delivered to each of the stages 50, 52, 64, 66 of the multistage solenoid 12, 60 by using the position information in the signal 80 from the sense coil 26, 62. In one example, pulse width modulation can be used to adjust the energy delivered to each of the stages 50, 52, 64, 66. It will be appreciated that the pulse width modulation can be used to reduce (or increase) the energy delivered to the multistage solenoid 12, 62 during movement of the armature 24, 72 between the extended condition (FIG. 5) and the retracted condition (FIG. 3) rather than just using pulse width modulation when the motion of the armature 24, 72 has terminated. It can be shown that the ability to deliver a variable amount of energy to the multistage solenoid 12 can result in a relative increase in battery life as energy consumption can be optimized for various depth settings of the depth setting control 142. It will be appreciated in light of the disclosure that the depth of the fastener 22 can be controlled in a similar fashion in the example with multiple sense coils as the fastening tool with the sense coil 102, 108, 112 in the multistage solenoid 100 (FIG. 6).

The ability to detect the signal 80 indicative of the position of the armature 24, 72 can provide the ability to conserve useful charge of the battery 20. By selectively energizing and then collapsing the magnetic fields in cascading fashion of each of the stages 50, 52, 64, 66 of the multistage solenoid 12, 60, the multistage solenoid 12, 60 can advance the driver blade 34, 74 to drive the fastener 22. Furthermore, each of the magnetic fields of the stages 50, 52, 64, 66 can be actively managed so only the needed amount of energy can be consumed by each of the stages 50, 52, 64, 66 during the driver sequence. Actively managing the stages 50, 52, 64, 66 can include relatively more accurately controlling the timing of the energizing and collapsing of the magnetic fields of the stages 50, 52, 64, 66. By more accurately limiting the duration during which the stages 50, 52, 64, 66 are energized, energy consumption can be reduced. Actively managing the magnetic fields of the stages 50, 52, 64, 66 can also include adjusting the magnetic field strength of each of the stages 50, 52, 64, 66 by using, for example, pulse width modulation. By adjusting the magnetic field strength of the stages 50, 52, the energy consumed can be minimized while the force imparted on the armature 24, 72 can be maximized. As such, the energy consumption needed to impart a certain force on the driver blade 34, 74 and the armature 24, 72 can be optimized.

It will be appreciated in light of the disclosure that the magnetic field strength of each of the stages 50, 52, 64, 66 can be computed and controlled by the control module 18, 82 based on the position of the armature 24, 72, a setting on the depth setting control 142 (FIG. 1), a type of the fastener 22, one or more previous driver sequences, an instant and nominal voltage of the battery 20 (FIG. 1) and one or more combinations thereof. In lieu of (or in addition to) the computation by the control module 18, 82, the control module 18, 82 can also reference one or more look-up tables, databases, data files or one or more combinations thereof.

The adjusting of the magnetic field strength of each of the stages 50, 52, 64, 66 based on previous driver sequences can include determining a total distance of travel of the driver blade assembly 14, 70 as the driver blade assembly 14, 70 moves through the driver sequence. The total distance of travel can be compared to a nominal distance the driver blade assembly 14, 70 should travel during the driver sequence. It will be appreciated in light of the disclosure that too little energy consumed can cause the driver blade assembly 14, 70 to travel too little (i.e., a partial stroke), especially into the workpiece 51 (FIG. 1) that is made of a hard material such as hardwood lumber. Too much energy, on the other hand, can cause the driver blade assembly 14, 70 to travel the nominal distance (i.e., a full stroke), but a stop 144 (FIG. 6) can absorb the excess energy from the driver blade assembly 14, 70 when there is excess velocity for a given application. In this regard, the velocity of the driver blade assembly 14, 70 can be estimated based on the signal 80 and, as appropriate, energy consumption can be reduced in subsequent driver sequences. When there is insufficient velocity, the energy consumed for the subsequent driver sequences can be increased, as appropriate.

Figure 11:
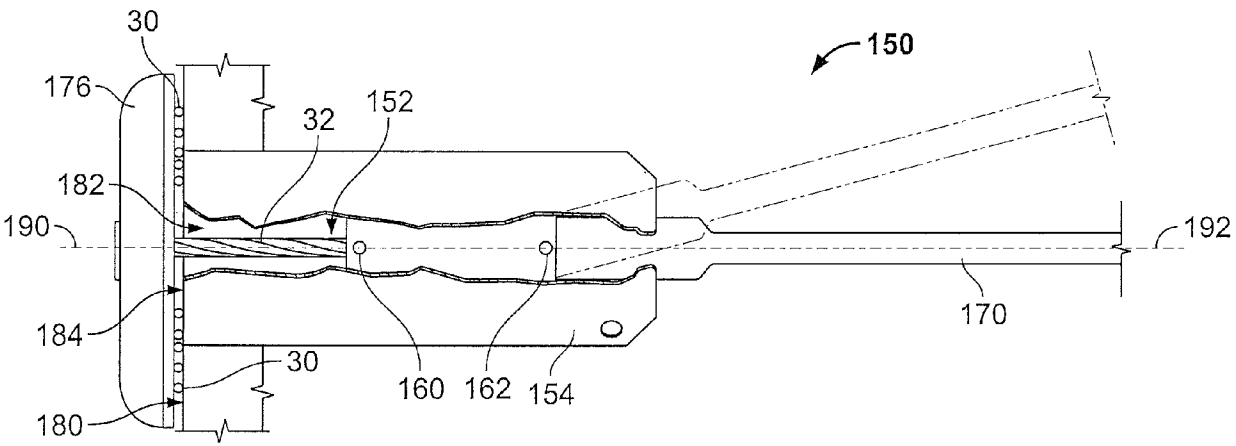
FIG. 11 is a partial perspective and cross-sectional view of the armature and the driver blade of FIG. 10 and shows the driver blade pivotally supported by the cylindrical member and the internal elastic member coupled thereto in accordance with the present teachings.

With reference to FIGS. 7-11, the fastening tool 10 can be configured with a driver blade assembly 150 that can be returned to the retracted condition (FIG. 7) with the internal elastic member 32 and the external coil member 30. The internal elastic member 32 can be coupled inside of a cavity 152 (FIG. 11) of a cylindrical member 154 associated with an armature 156 of the driver blade assembly 150. With reference to FIG. 11, the cylindrical member 154 can include an anchor member 160 that can connect the internal elastic member 32 to the cylindrical member 154. The cylindrical member 154 can also include a pivot pin 162 to which a driver blade 170 can be partially rotatably supported. In this regard, the driver blade 170 can move independent of the cylindrical member 154 as the driver blade assembly 150 travels through a multistage solenoid 172 contained in a tool housing 174.

The driver blade assembly 150 can include the cylindrical member 154 that can function as the armature 156. The driver blade assembly 150 can also include the driver blade 170 that can travel through the nosepiece 40 to insert the fastener 22 as discussed above and with reference to FIGS. 1 and 2. The driver blade assembly 150 can also include a cap member 176 to which the external coil member 30 and internal elastic member 32 can be connected. The multistage solenoid 172 can move the driver blade assembly 150 from the retracted condition to the extended condition, while the external coil member 30 and the internal elastic member 32 can be employed to return the driver blade assembly 150 from the extended condition to the retracted condition thus completing the driver sequence.

Figure 7:
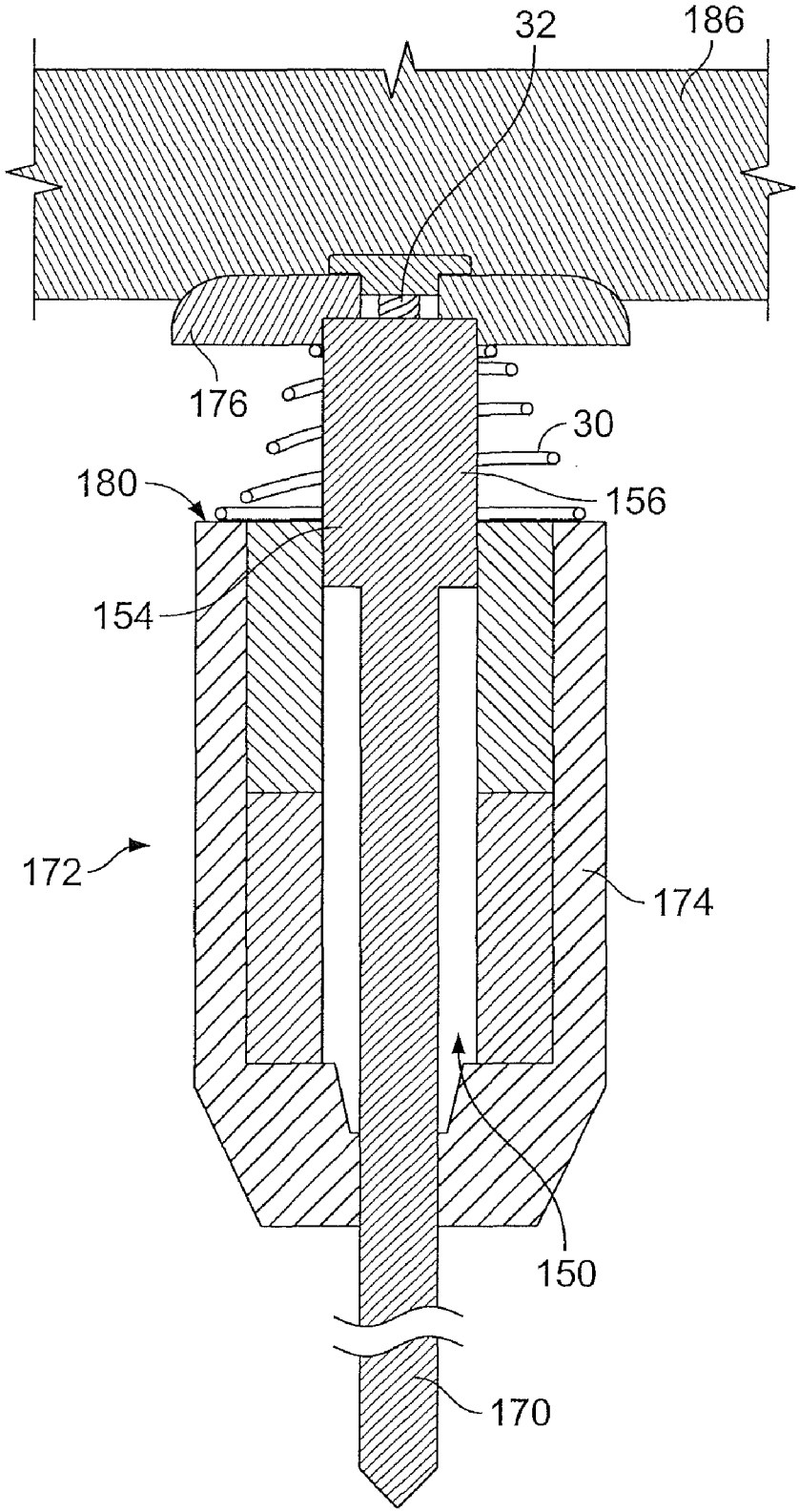
FIG. 7 is a diagram of a further example of a multistage solenoid showing an internal elastic member and an external coil member that can return the driver blade assembly to the retracted condition in accordance with the present teachings.

With reference to FIG. 7, the internal elastic member 32 can extend between the cap member 176 and the cylindrical member 154 of the driver blade assembly 150. The cap member 176 can also contain the external coil member 30 between the cap member 176 and a top portion 180 of the multistage solenoid 172. As the driver blade assembly 150 moves from the retracted condition (FIG. 7) to the extended condition (FIG. 9); initially, the cap member 176 can move downward to compress the external coil member 30 against the top portion 180 of the multistage solenoid 172.

In one example, when the external coil member 30 can no longer be compressed (i.e., complete or almost complete coil on coil contact), the internal elastic member 32 can begin to elongate as the cylindrical member 154 moves downward relative to the cap member 176. It will also be appreciated in light of the disclosure that the predetermined spring constants of the internal elastic member 32 and/or the external coil member 30 can be selected so that the internal elastic member 32 can begin to elongate before (or after) the external coil member 30 is fully compressed against the top portion 180 of the multistage solenoid 172.

The internal elastic member 32 is further stretched as the internal elastic member 32 can extend from the cavity 152 formed in the cylindrical member 154. It will be appreciated in light of the disclosure that the internal elastic member 32 and the external coil member 30 can be disposed between the cap member 176 and the top portion 180 of the multistage solenoid 172 in a pre-compressed condition. In the pre-compressed condition, neither the internal elastic member 32 nor the external coil member 30 remains in an uncompressed state (i.e., completely relaxed) in the cordless fastening tool 10, regardless of the position of the driver blade assembly 150.

In the retracted condition, the internal elastic member 32 can be contained within the cavity 152 of the cylindrical member 154. In this regard, the cylindrical member 154 can define an aperture 182 formed in a generally central position on a top surface 184 (FIG. 11) of the cylindrical member 154. The top surface 184 can be a surface of the cylindrical member 154 that can abut the top portion 180 of the multistage solenoid 172.

In the retracted condition, almost all of the internal elastic member 32 can be contained within the aperture 182 and the cavity 152 formed within the cylindrical member 154. In this regard, the cap member 176 can abut the cylindrical member 154 until the internal elastic member 32 begins to expand when the cap member 176 contacts the top portion 180 of the multistage solenoid 172. As the driver blade 170 (and the greater driver blade assembly 150) move from the retracted condition to the extended condition, the internal elastic member 32 can be further elongated (further loaded) and can extend from the aperture 182 formed in the cylindrical member 154. When the driver blade assembly 150 returns to the retracted condition, the cap member 176 can abut a stop member 186 (FIGS. 2 and 3) that can be contained in the tool housing 174 of the cordless fastening tool 10. It will be appreciated in light of the disclosure that the aperture 182 and the internal elastic member 32 can extend along a longitudinal axis 190 that is generally coaxial with a longitudinal axis 192 of the driver blade 170 that can intersect the pivot pin 162; unless, of course, the driver blade 170 has pivoted out of alignment with the longitudinal axis 190.

The internal elastic member 32 and the external coil member 30 permit the cordless fastening tool 10 to return the driver blade 170 from the extended condition to the retracted condition without the need to energize the multistage solenoid 172. In one example, the driver blade assembly 150 can be obstructed and held in the extended condition because the driver blade 170 is in a jam condition. The jam condition can define, for example, the driver blade 170 being held in the extended condition due to a misalignment of the fastener 22. When the user 140 partially disassembles the nosepiece 40 of the cordless fastening tool 10 (FIG. 1) to remove the misaligned fastener (not specifically shown), the internal elastic member 32 and the external coil member 30 can move the driver blade assembly 150—when unobstructed—back to the retracted condition.

It will be appreciated in light of the disclosure that the multistage solenoid 172 need not be energized, i.e., no electrical power needs to be directed to the cordless fastening tool 10, to return the driver blade 170 to the retracted condition. It will further be appreciated in light of the disclosure that the battery 20 (FIG. 1) can be removed from the cordless fastening tool 10 when the user 140 intends to remove the fastener 22 that had been misaligned. As the user 140 partially disassembles the nosepiece 40 with the battery 20 removed, the driver blade 170 can still be permitted to return to the retracted condition and, in doing so, can provide an indication to the user 140 that the jam is cleared.

Figure 12:
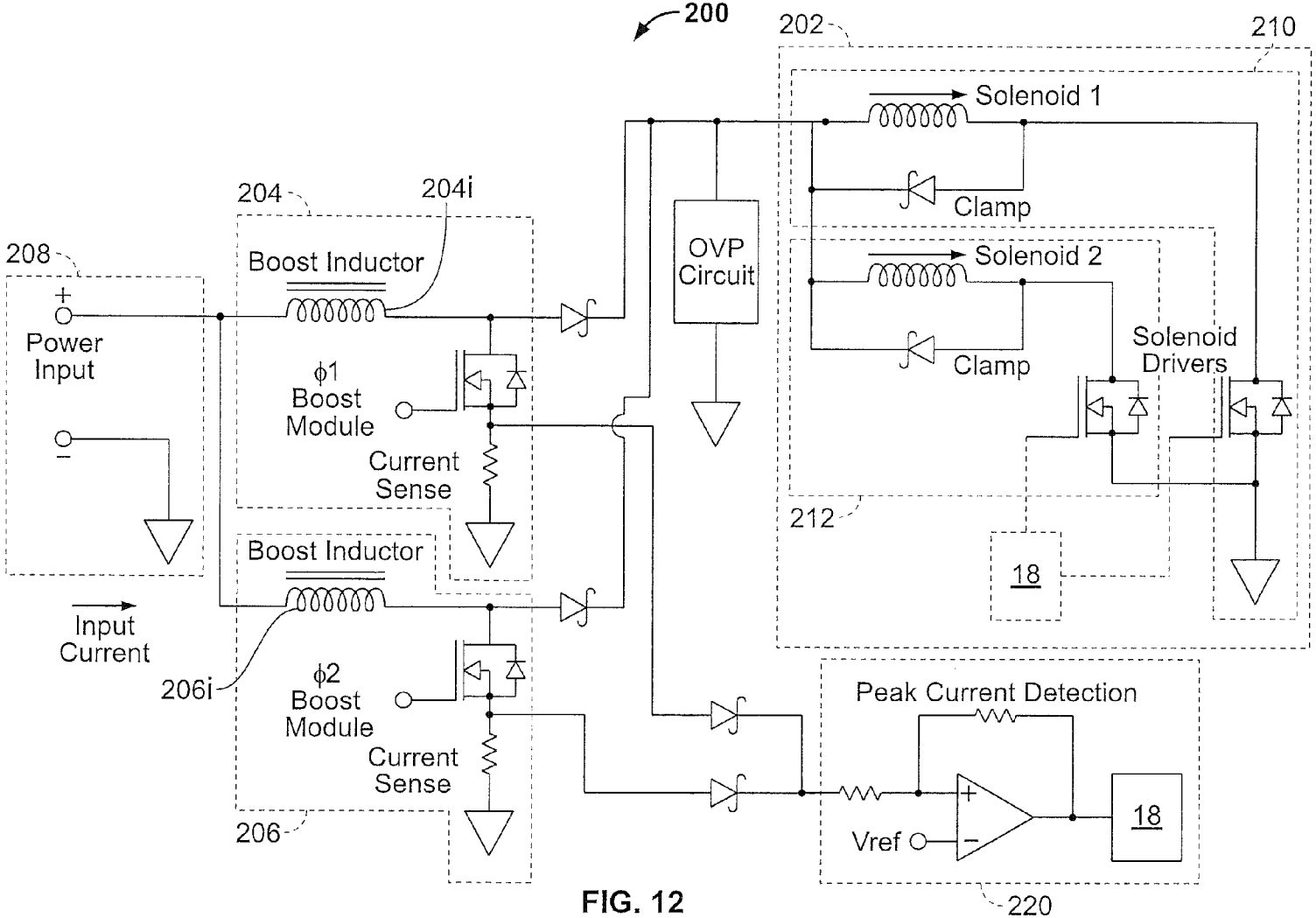
FIG. 12 is a diagram of an exemplary multiphase voltage boosting circuit that can deliver increased current at a boost voltage to the stages of a multistage solenoid to increase the force imparted on the driver blade assembly of the cordless fastening tool in accordance with the present teachings.
Figure 13:
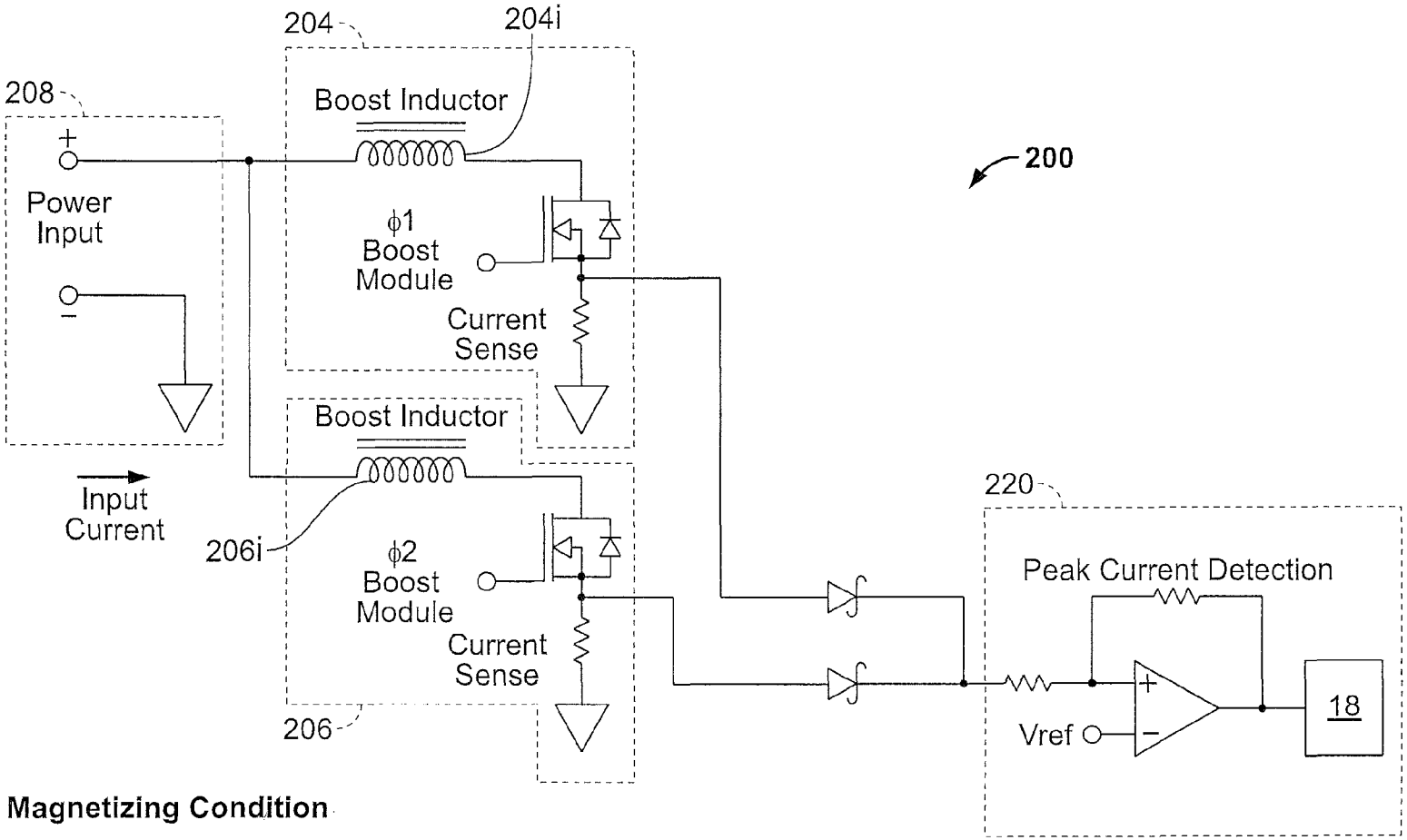
FIG. 13 is similar to FIG. 12 and shows the voltage boosting circuit in a charge condition in accordance with the present teachings.
Figure 14:
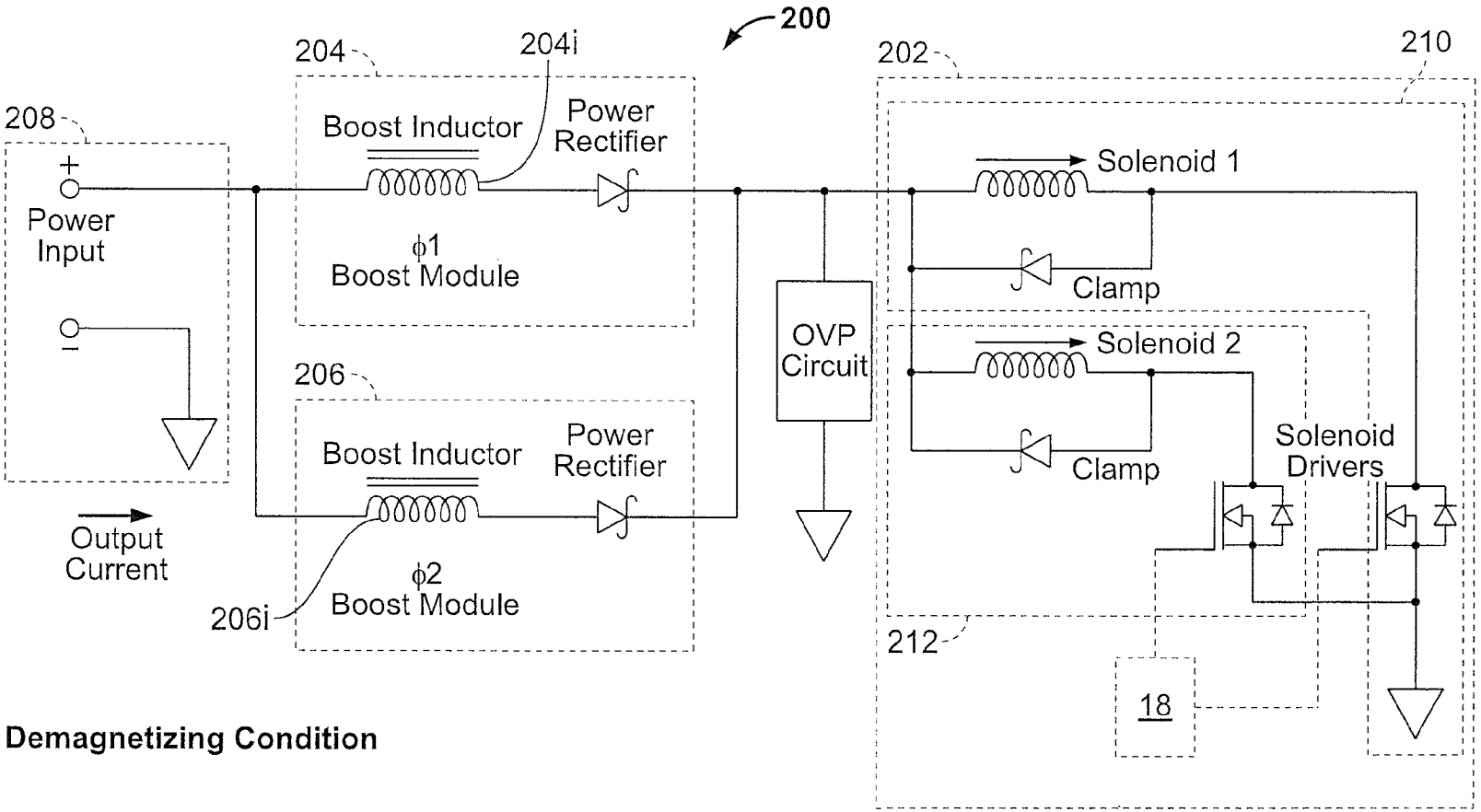
FIG. 14 is similar to FIG. 12 and shows the voltage boosting circuit in a discharge condition that delivers the increased current from a battery to each of the stages of the multistage solenoid in accordance with the present teachings.

With reference to FIGS. 12, 13 and 14, the fastening tool 10 (FIG. 1) can be configured with a voltage boosting circuit 200 that can provide an increased voltage to a multistage solenoid 202. The increased voltage can facilitate a transient increase in current that can be beneficial when the multistage solenoid 202 is energized to move the driver blade 34 (FIG. 2) through the driver sequence. The voltage boosting circuit 200 can include at least a first boost module 204 and a second boost module 206 to be charged by a battery 208. The battery 208 can deliver DC voltage at a suitable, nominal voltage such as 18-volts, but other nominal voltages, such as those supported by a battery chemistry such as lithium ion, nickel cadmium, etc., can be used to supply power to the cordless fastening tool 10.

Similar to the multistage solenoid 12, 60, 100, 172 (FIGS. 2-11), the multistage solenoid 202 can have at least a first stage 210 and a second stage 212. A magnetic field can be selectively energized (or clasped) in each of the stages 210, 212 when current is directed through each of the stages 210, 212, which can comprise copper coil windings. The magnetic fields of the stages 210, 212 can be energized and de-energized in a cascading fashion, to advance the driver blade 34 through the driver sequence, as discussed herein.

When the stages 210, 212 are energized, a force is imparted on the armature 24 (see, e.g., FIG. 2) of the driver blade assembly 14 to move the driver blade assembly 14 from the retracted condition (FIG. 3) to the extended condition (FIG. 5). The force imparted on the armature 24 is proportional to the value of current that defines the one or more magnetic fields. It will be appreciated in light of the disclosure that the force imparted on the armature 24 by the stages 210, 212 when operating at the nominal voltage of the battery 208 is less than a force that can be delivered to the armature 24 when the stages 210, 212 are boosted to an increased voltage by the boost modules 204, 206. At the larger boost voltage, more current can be delivered to the stages 210, 212, which increases the force imparted on the armature 24, while generally operating the fastening tool 10 (FIG. 2) at the nominal voltage of the battery 208.

With reference to FIG. 13, voltage boosting circuit 200 in the magnetizing condition is illustrated. Each boost module 204, 206 of the voltage boosting circuit 200 can be magnetized to develop a boost voltage at the output of the first boost module 204 and the second boost module 206. This can occur upon the retraction of the trigger 56 of the trigger assembly 54 (FIG. 1). In this condition, current can be delivered to the first boost module 204 and the second boost module 206, which can be stored, e.g., in inductors 204*i* and 206*i*. As described below, the current to first and second boost modules 204, 206 can be discontinued in the demagnetizing condition to boost the value of the voltage higher than the nominal voltage of the battery 208 (e.g., 18-volts) when delivered to the multistage solenoid 202.

The voltage boosting circuit 200 can magnetize and demagnetize the boost modules 204 and 206 multiple times (e.g., on the order of 1000 times) while the stages 210, 212 are energizing. When the voltage boosting circuit 200 discontinues current to boost modules 204, 206, the boost voltage delivered to the stages 210, 212 can be approximately equal to the nominal battery voltage plus the boost voltage. It will be appreciated in light of the disclosure that as the boost modules 204, 206 demagnetize, the boost voltage will decrease. At this point, current can be restored to the boost modules 204, 206 to re-magnetize the boost modules 204, 206. Current can then be discontinued to the boost modules 204, 206 to once again develop the boost voltage at the output of boost modules 204, 206. When the trigger assembly 54 (FIG. 1) remains retracted (e.g., the trigger 56 is still pulled), the boost modules 204, 206 can continuously switch between the magnetizing condition and the demagnetizing condition (FIG. 14) to provide the nominal battery voltage plus the boost voltage to the stages 210, 212.

Returning to FIG. 12, a peak current detection module 220 can limit the current delivered to each of the boost modules 204, 206 to prevent saturation of boost modules 204, 206. The two boost modules 204, 206 can be used in tandem (e.g., one hundred eight degree phase shift) to reduce current ripple in the energized solenoid windings of the stages 210, 212. The peak current protection module 220 can be part of (or connect to) the control module 18 for the fastening tool 10 (FIG. 2). When the boost modules 204, 206 are demagnetizing, current delivered by the voltage boosting circuit 200 can be at a boost voltage which is the combination of the nominal battery voltage and the voltage produced at the boost modules 204, 206 when energizing the stages 210, 212 of the multi-stage solenoid.

It will be appreciated in light of the disclosure that the voltage boosting circuit 200 can be configured for a low duty cycle operation. In this regard, the voltage boosting circuit 200 can be configured to operate in a transient fashion, as operating continuously could cause excess heat production. It will be appreciated in light of the disclosure that the control module 18 can de-energize the multistage solenoid 202 and in doing so can discontinue the boosting of the multistage solenoid 202 by the boost modules 204, 206 even when the driver sequence is not complete.

It will be appreciated in light of the present disclosure that the boost modules 204, 206 can be implemented in the voltage boosting circuit 200 in greater numbers (i.e., more than two) or only a single boost module need be used. It will also be appreciated in light of the present disclosure that the number of boost modules used in the fastening tool 10 can be based on various considerations including the amount of force imparted on the armature 24 by the multistage solenoid 12, packaging of the fastening tool 10 and moreover cost and complexity for the fastening tool 10.

Figure 15:
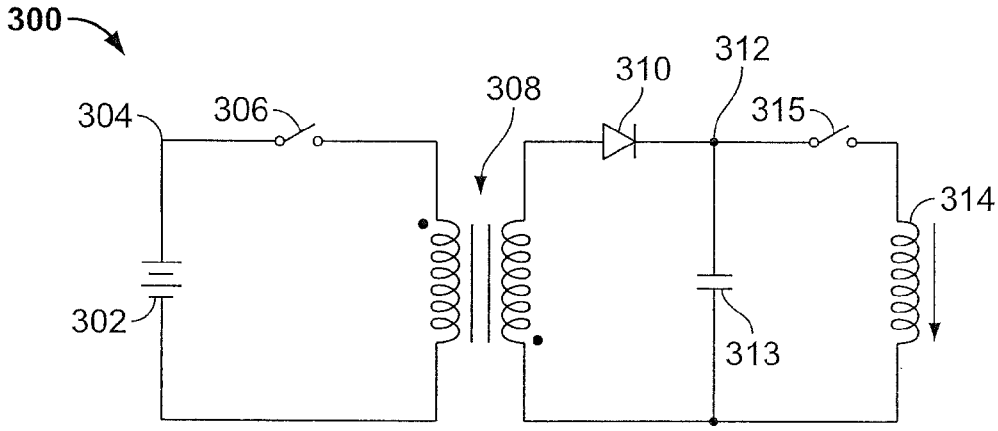
FIG. 15 is a diagram of another example of a voltage boosting circuit that can deliver increased current at the boost voltage to the stages of the multistage solenoid to increase the force imparted on a driver blade assembly of the cordless fastening tool in accordance with the present teachings.
Figure 16:
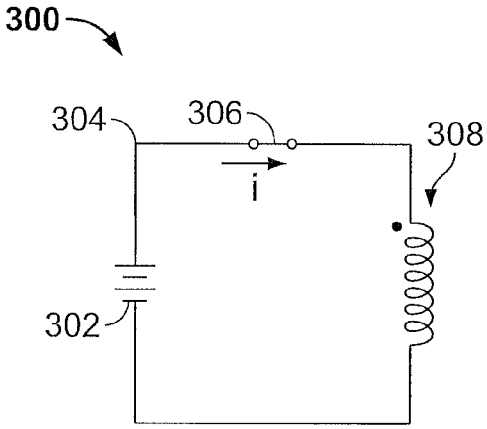
FIG. 16 is similar to FIG. 15 and shows the voltage boosting circuit in a charge condition in accordance with the present teachings.
Figure 17:
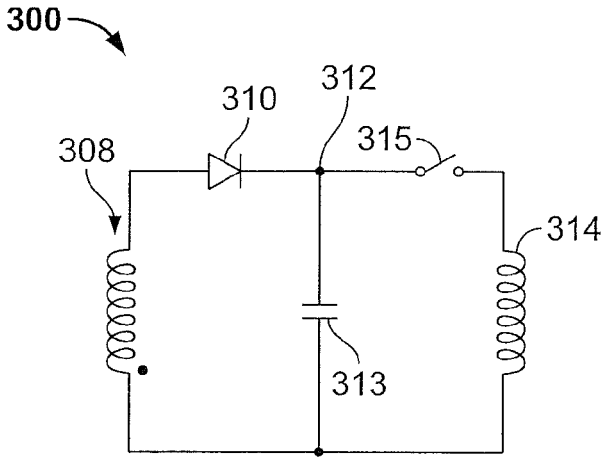
FIG. 17 is similar to FIG. 15 and shows the voltage boosting circuit in a discharge condition in accordance with the present teachings.

With reference to FIGS. 15, 16, and 17, similar to the voltage boosting circuit 200 (FIG. 12), the fastening tool 10 (FIG. 1) can be configured with a voltage boosting circuit 300 that can provide the transient boost voltage. A battery 302 that can supply a nominal voltage (e.g., 18 volts) to the voltage boosting circuit 300 can be connected to an input 304. The input 304 can connect to a switch 306, which can comprise a switching transistor that can connect to a high frequency transformer 308. A power rectifier, such as diode 310, can connect to the transformer 308 and can deliver an output 312. A capacitor 313 can store the energy delivered to the output 312 and, ultimately, to a multistage solenoid 314 upon closure of a firing switch 315. The switch 306 on the input 304 can control the flow of current through the transformer 308. In this regard, the voltage boosting circuit 300 can, in part, provide functionality similar to a flyback converter switching power supply.

In one example and with reference to FIG. 16, the switch 306 can be closed and the core of the transformer 308 can be magnetized by current flowing through the primary windings of the transformer 308. As such, the voltage boosting circuit 300 can be in the charge condition. One cycle of magnetic energy can be stored in the core of the transformer 308. With reference to FIG. 17, the switch 306 can be in an off condition and, as such, high voltage (i.e., higher than the nominal voltage of the battery 302) can develop across the secondary windings of the transformer 308. It will be appreciated in light of the disclosure that the boost voltage at the output 312 can be based on a turns ratio (or voltage ratio) of the transformer 308. In the discharge condition (FIG. 17), the output rectifier 310 can convert the pulsing output from the transformer 308 to direct current (DC) output 312 to energize the stages of the multistage solenoid 314.

Figure 18:
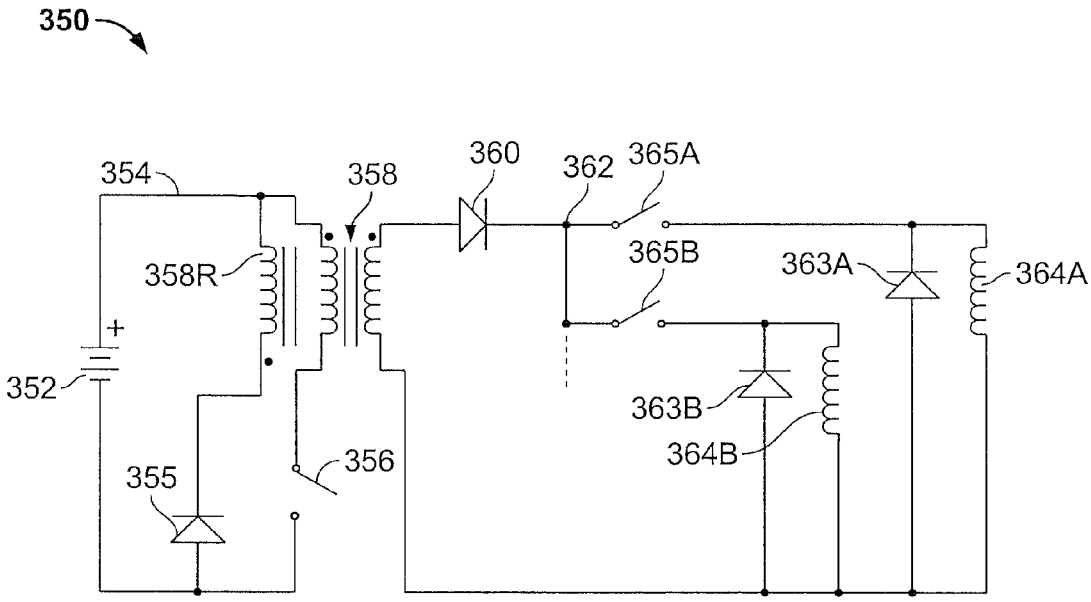
FIG. 18 is a diagram of a further example of a voltage boosting circuit of the cordless fastening tool in accordance with the present teachings.

With reference to FIG. 18, similar to the voltage boosting circuit 300 (FIG. 12) described above, the fastening tool 10 (FIG. 1) can be configured to include a voltage boosting circuit 350 that can provide the transient boost voltage. A battery 352 can connect to an input 354 that can supply a nominal voltage (e.g., 18 volts) to the voltage boosting circuit 350. The input 354 can connect to a high frequency transformer 358, which is connected to a switch, e.g., a switching transistor 356. Transformer 358 may include a "reset" winding arrangement 358R, that is connected to one terminal of battery 352 through diode 355. The secondary winding of transformer 358 is connected to output 362 through a power rectifier, e.g., a diode 360. Firing switches 365A-365B are utilized to select which of the solenoids (364A-364B) will receive the voltage from output 362. Solenoids 364A, 364B may comprise the individual stages of a multistage solenoid. Further, voltage boosting circuit 350 may be connected with any number of solenoids or any number of stages of a multistage solenoid. Diodes 363A and 363B are connected in parallel to multistage solenoids 364A, 364B, respectively. Switching transistor 356 operates to control the input to transformer 358. When switch 356 is closed, current is delivered to the primary winding of transformer 358 and, through secondary winding, to output 362. Firing switching 365A, 365B are closed depending on which of the multistage solenoids 364A, 364B is desired to receive the voltage boost. When switch 356 is open, reset winding 358R in combination with diode 355 operate to reset the core of transformer 358. Reset winding 358R assists in the prevention of saturation of the magnetic core of transformer 358. In this regard, the voltage boosting circuit 350 can, in part, provide functionality similar to a forward converter switching power supply.

It will be appreciated in light of the disclosure that the above switching power supply examples can be implemented, in part, similar to a push-pull converter switching power supply. As such, the transformer can be configured with one or two primary windings and two (or four) switching transistors, which can be shown to provide a benefit that can include a balanced magnetization loop because no direct current is in the primary windings of the transformer. This can be shown to permit use of a smaller transformer for a given output power because the magnetic material in the transformers can be more efficiently utilized. It will also be appreciated in light of the disclosure that different arrangements can be implemented, such as the inclusion of a center-tapped transformer and additional switching transistors. In a further example, the above switching power supply examples can also be implemented, in part, similar to a Royer converter switching power supply. As such, the transformer can be configured to self-oscillate using transistor driving signals in lieu of the switching transistors discussed herein.

In yet another example, the above switching power supply examples can also be implemented similar to a DC to AC inverter. The DC to AC inverter can first boost the nominal voltage of the battery voltage up to the boost voltage using any of the above methods. An output can then be chopped using transistors to produce a 60 Hz wave. In this regard, the 60 Hz AC power can be used to drive an AC operated multistage solenoid in a fastening tool. This arrangement could further be implemented on fastening tools that can operate in both a cordless manner and a corded manner, such as a hybrid tool that can be both battery operated or corded and connect to a wall voltage.

Figure 19:
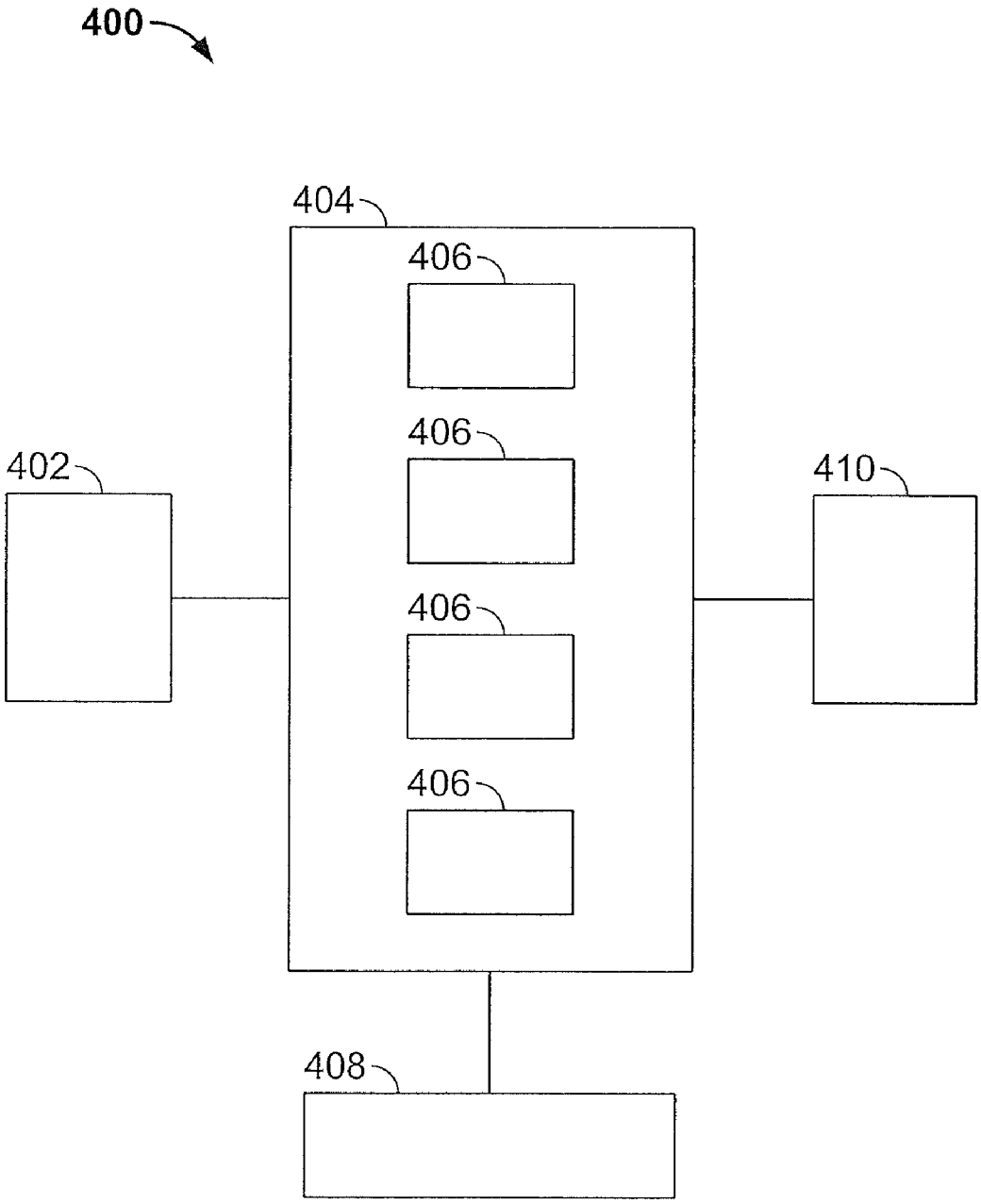
FIG. 19 is a diagram of yet another example of a voltage boosting circuit of the cordless fastening tool in accordance with the present teachings.

With reference to FIG. 19, similar to the voltage boosting circuit 300 (FIG. 12), the fastening tool 10 (FIG. 1) can be configured with a voltage boosting circuit 400 that can provide a transient boost voltage. A battery 402 can connect to a boost module 404. The boost module 404 can contain multiple capacitors 406 (or one) that can be individually controlled or controlled as a group by a boost control 408. The boost module 404 can deliver the boost voltage and increased current to a multistage solenoid 410.

When the capacitors 406 are charged, the boost control 408 of the voltage boosting circuit 400 can switch the capacitors 406 such that they are now in series with the voltage of the battery 402. It will be appreciated in light of the disclosure that when the switching frequency is relatively high, the capacitors 406 can be relatively compact in size. In one example, the switching frequency can be about ten kilohertz and, in this instance, the boost control 408 can be electronic. When switching frequencies are lower, however, mechanical and/or electronic switches can be implemented. Output of the capacitors 406 to the multistage solenoid 410 can be delivered as multiple relatively small pulses which can (or need not) be staggered in time.

Referring now to FIGS. 20-23, various embodiments of voltage boosting modules 500*a*-500*d* are disclosed. Similar to the voltage boosting circuit 400 discussed above, boost modules 500*a*-500*d* differ from boost modules 204, 206 in that capacitors, instead of inductors as in boost modules 204, 206, are utilized to boost the nominal voltage of the battery to a level suitable for use with the fastening tool, as described above. Boost modules 500*a*-500*d* can be substituted for boost modules 204, 206 in FIGS. 12-14.

Figure 20:
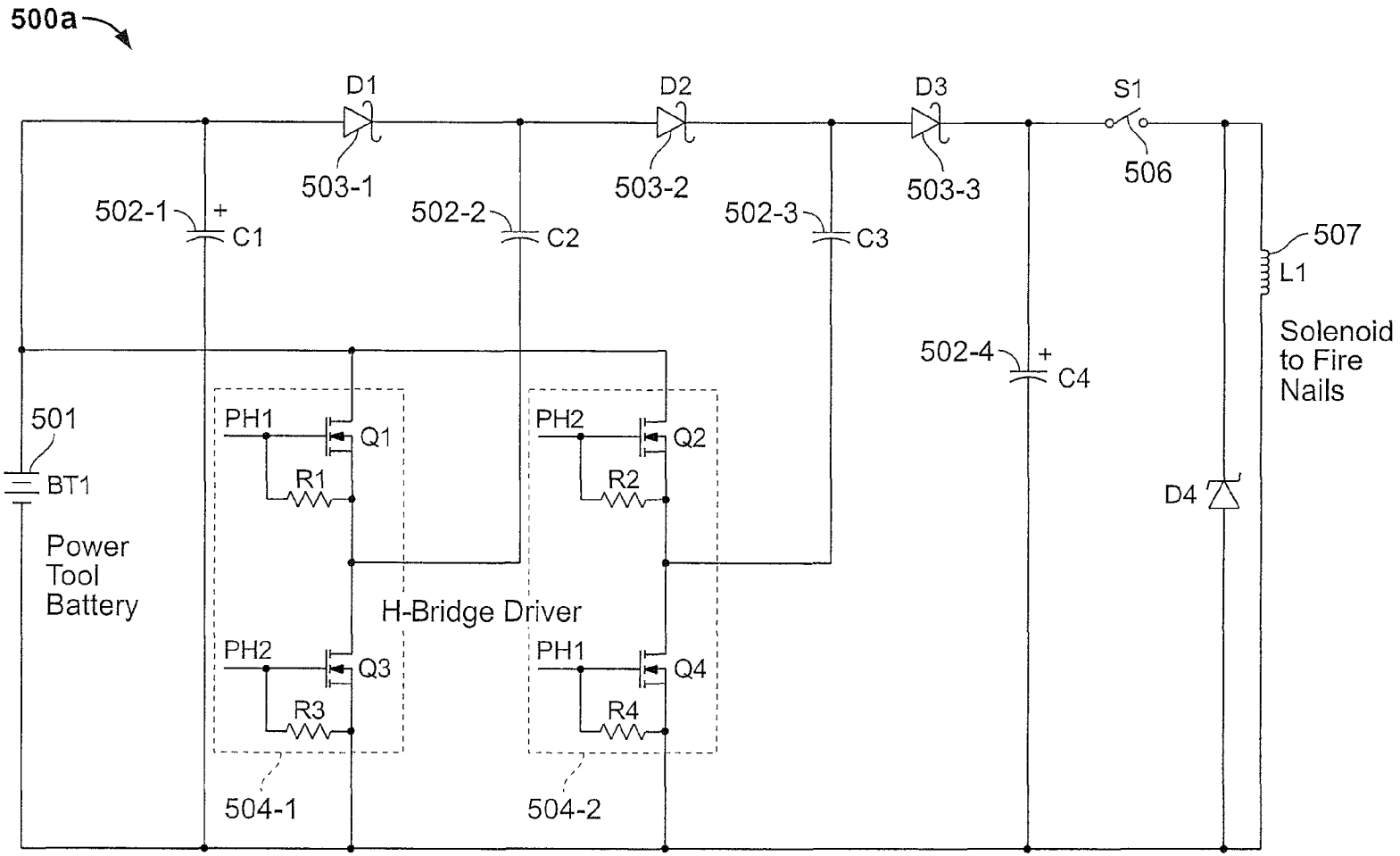
FIG. 20 is a diagram of an exemplary voltage boosting circuit in accordance with the present teachings.

Referring now to FIG. 20, voltage boosting module 500*a* includes capacitors 502-1 to 502-3, which are connected to a battery 501. Switching modules 504-1, 504-2 are also connected to the capacitors 502-1 to 502-3 and selectively switch the connection of the capacitors to either the positive or negative terminal of the battery 501, for example, by use of transistors as illustrated. In this manner, and through the use of diodes 503-1 to 503-3, provides voltage boosting module 500*a* for a voltage at node 505 that is approximately triple that of the voltage of the battery 501. A capacitor 502-4 is utilized to store this voltage, which can be provided to a solenoid 507 upon closing of firing switch 506.

Figure 21:
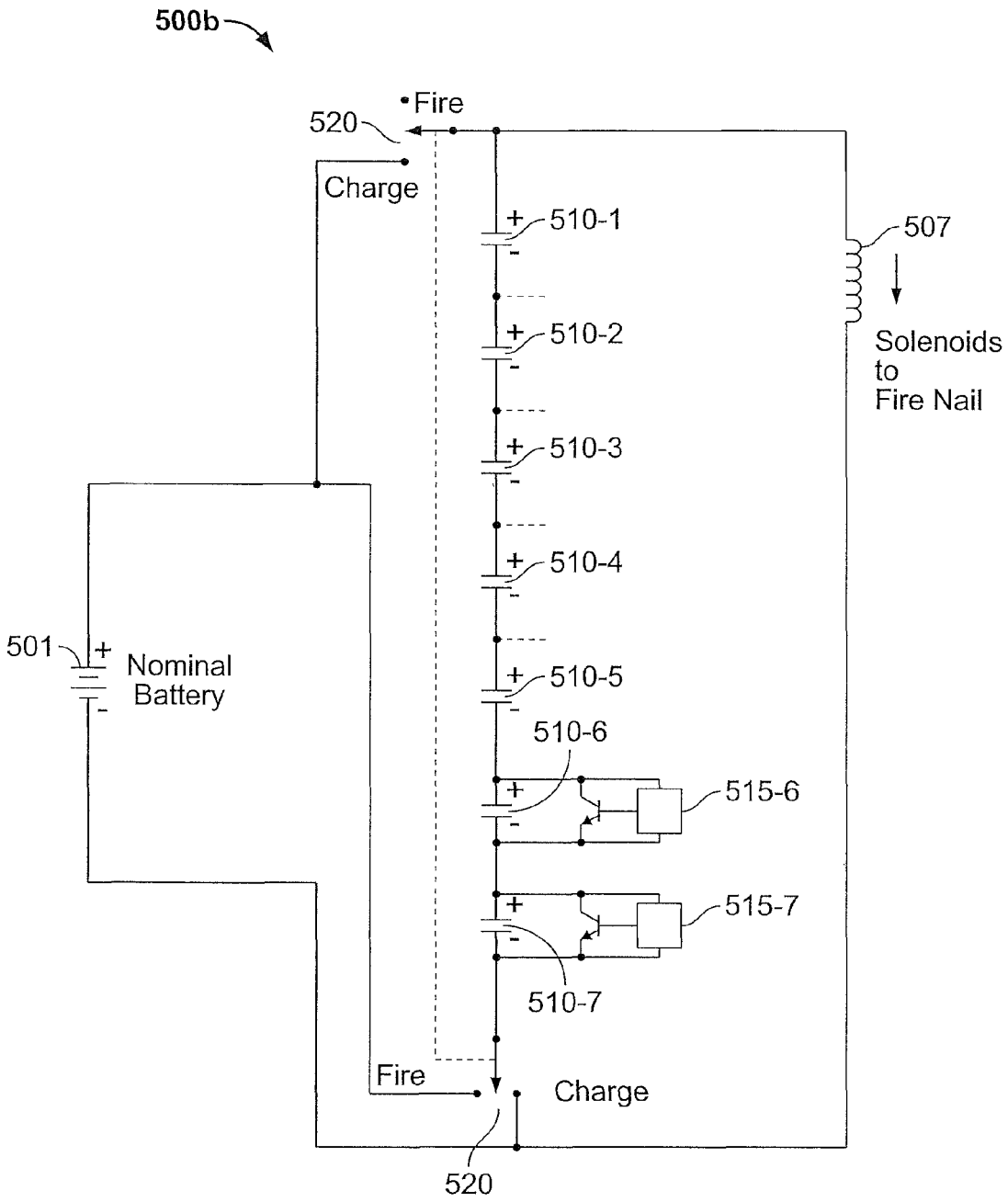
FIG. 21 is a diagram of another exemplary voltage boosting circuit in accordance with the present teachings.

Referring now to FIG. 21, a voltage boosting module 500*b* according to some embodiments of the present disclosure is illustrated. Similar to voltage boosting module 500*a* above, the capacitors 510-1 to 510-7 are connected to the battery 501 during the charging phase. For each of the capacitors 510-1 to 510-7, a balancing circuit 515-1 to 515-7, respectively, is utilized. A firing switch 520, once connected to the firing phase, connects the positive terminal of the battery 501 to the negative terminal of the capacitor 510-7 such that a voltage approximately double that of the battery 501 can be provided to the solenoid 507. In essence, the firing switch 520 changes the configuration of the capacitors/battery connection from in parallel, during the charging phase, to in series, in the firing stage. The boost module 500*b* is sometimes referred to as a voltage doubler.

Figure 22:
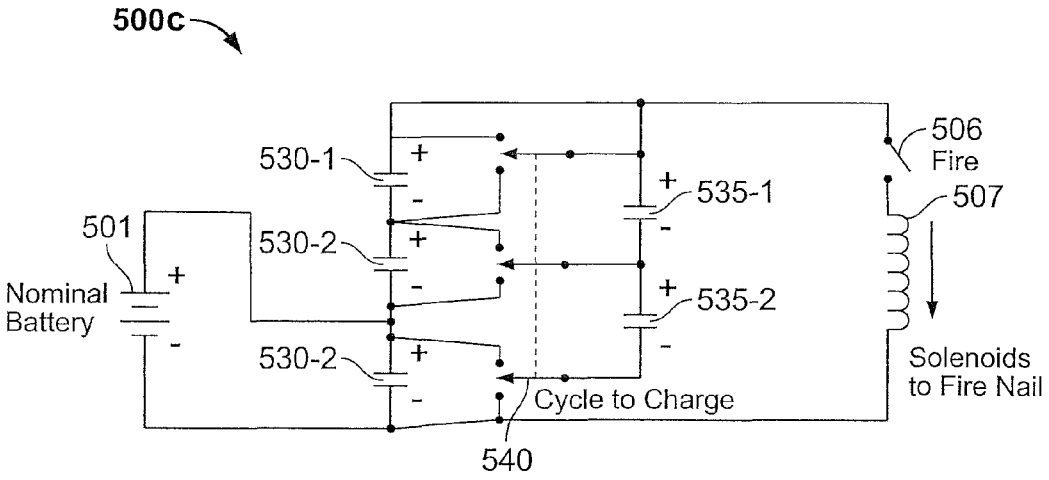
FIG. 22 is a diagram of a further exemplary voltage boosting circuit in accordance with the present teachings.

Referring now to FIG. 22, a voltage boosting module 500*c* according to some embodiments of the present disclosure is illustrated. In this module, multiple capacitors 530-1 to 530-3 are connected to the battery 501 through connections with flying capacitors 535-1 and 535-2 and the charging switch 540. Charging switch 540 cycles the connections of capacitors 530 and capacitors 535 such that a voltage approximately three times that of the voltage of the battery 501 is present at the firing switch 506. Upon closing of the firing switch 506, the solenoid 507 will utilize the boost voltage to fire the fastening tool, as described above.

Figure 23:
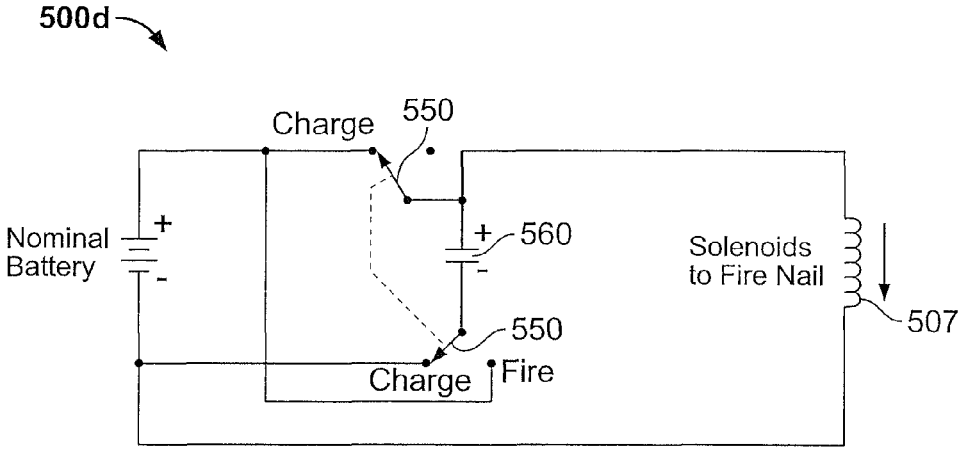
FIG. 23 is a diagram of yet another exemplary voltage boosting circuit in accordance with the present teachings.

Referring now to FIG. 23, a voltage boosting module 500*d* is illustrated. The boosting module 500*d* is similar to the boost module 500*b* illustrated in FIG. 21 described above. Voltage boosting module 500*d* acts to alternate between a charge and firing status. In the charged status, a capacitor bank 560 is connected to both terminals of the battery 501 such that the capacitor bank 560 stores a voltage equal to the voltage of the battery 501. Upon selection of the firing phase, the terminal of the capacitor bank 560 that was connected to the negative terminal of the battery 501 during the charge phase is instead connected to the positive terminal of the battery 501. Thus, the battery 501 and the capacitor bank 560 are effectively in series with each other and a voltage equal to approximately double that of the battery 501 is provided to the solenoid 507 to fire the fastener.

While specific aspects have been described in the specification and illustrated in the drawings, it will be understood by those skilled in the art that various changes can be made and equivalents can be substituted for elements thereof without departing from the scope of the present teachings. Furthermore, the mixing and matching of features, elements, and/or functions between various aspects of the present teachings may be expressly contemplated herein so that one skilled in the art from the present teachings that features, elements, and/or functions of one aspect of the present teachings may be incorporated into another aspect, as appropriate, unless described otherwise above. Moreover, many modifications may be made to adapt a particular situation, configuration or material to the present teachings without departing from the essential scope thereof. Therefore, it is intended that the present teachings not be limited to particular aspects illustrated by the drawings described in the specification as the best mode presently contemplated for carrying out the present teachings, but that the scope of the present teachings include many aspects and examples following within the foregoing description and the appended claims.

What is claimed is:

1. A fastening device that drives one or more fasteners into a workpiece, the fastening device comprising:

a tool housing;

a multistage solenoid contained in said tool housing, said multistage solenoid includes an armature member that travels through at least a first stage, a second stage and a sense coil disposed therebetween;

a driver blade assembly including a driver blade connected to said armature member, wherein said driver blade and said armature member are movable between an extended condition and a retracted condition;

a trigger assembly connected to a control module and partially contained within said tool housing, wherein said trigger assembly is operable to activate a driver sequence that moves said driver blade between said retracted condition and said extended condition; and a voltage boosting circuit having a first boost module and a second boost module that charge to a boost voltage when said trigger assembly activates said driver sequence, wherein said first boost module and said second boost module deliver an increased current from a battery to said multistage solenoid at said boost voltage.

2. The fastening device of claim 1, wherein said delivery of said increased current from said battery to said multistage solenoid at said boost voltage from said first boost module is staggered in time from said second boost module.

3. The fastening device of claim 1, wherein said voltage boosting circuit includes an inductor and a zener diode.

4. The fastening device of claim 1, wherein said voltage boosting circuit includes a switching transistor and a transformer.

5. The fastening device of claim 1, wherein said voltage boosting circuit includes a transformer that is self-oscillating.

6. The fastening device of claim 1, wherein said voltage boosting circuit includes a DC to AC inverter.

7. The fastening device of claim 1, wherein said voltage boosting circuit includes multiple capacitors.

8. The fastening device of claim 1 further comprising a switch including multiple capacitors that can be in parallel with a battery when in a charge condition and said switch can rearrange said multiple capacitors to be in series with said battery in a discharge condition.

9. The fastening device of claim 8, wherein said switch is electronic and operates at about ten thousand kilohertz.

10. The fastening device of claim 9, wherein said voltage boosting circuit delivers about five hundred watts of power.

* * * * *